US010578988B2

(12) United States Patent
Yamauchi et al.

(10) Patent No.: US 10,578,988 B2
(45) Date of Patent: Mar. 3, 2020

(54) TONER, IMAGE FORMING APPARATUS, AND TONER STORED UNIT

(71) Applicants: Yoshitaka Yamauchi, Shizuoka (JP); Kazumi Suzuki, Shizuoka (JP); Hisashi Nakajima, Shizuoka (JP); Saori Yamada, Shizuoka (JP); Yu Naito, Shizuoka (JP); Akihiro Kaneko, Shizuoka (JP)

(72) Inventors: Yoshitaka Yamauchi, Shizuoka (JP); Kazumi Suzuki, Shizuoka (JP); Hisashi Nakajima, Shizuoka (JP); Saori Yamada, Shizuoka (JP); Yu Naito, Shizuoka (JP); Akihiro Kaneko, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/567,631

(22) PCT Filed: Mar. 24, 2016

(86) PCT No.: PCT/JP2016/001703
§ 371 (c)(1),
(2) Date: Oct. 19, 2017

(87) PCT Pub. No.: WO2016/170730
PCT Pub. Date: Oct. 27, 2016

(65) Prior Publication Data

US 2018/0113391 A1 Apr. 26, 2018

(30) Foreign Application Priority Data

Apr. 21, 2015 (JP) ..... 2015-086658
Aug. 18, 2015 (JP) ..... 2015-160925

(51) Int. Cl.
*G03G 9/08* (2006.01)
*G03G 9/087* (2006.01)
*G03G 15/08* (2006.01)

(52) U.S. Cl.
CPC ..... *G03G 9/0821* (2013.01); *G03G 9/08711* (2013.01); *G03G 9/08755* (2013.01); (Continued)

(58) Field of Classification Search
CPC ..... G03G 9/0821; G03G 9/08755; G03G 15/0865
See application file for complete search history.

(56) References Cited

U.S. PATENT DOCUMENTS 7,261,989 B2 8/2007 Sugiura et al.
7,318,989 B2 1/2008 Kotsugai et al.
(Continued)

FOREIGN PATENT DOCUMENTS

EP 2 434 347 A1 3/2012
JP 2002-287426 10/2002
(Continued)

OTHER PUBLICATIONS

Extended European Search Report dated Mar. 8, 2018 in European Patent Application No. 16782758.3, citing documents AA, AB, and AO therein, 9 pages.
(Continued)

*Primary Examiner* — Thorl Chea
(74) *Attorney, Agent, or Firm* — Oblon, McClelland, Maier & Neustadt, L.L.P.

(57) ABSTRACT

A toner, where a diffraction peak of the toner as measured by X-ray diffraction spectroscopy is present at least in a region where 2θ is from 20° through 25°, and a difference between Tg1 and Tg2 is 10° C. or less, where Tg1 is a glass transition temperature of the toner, as observed in a last heating step,
(Continued)

when heating and cooling are performed on the toner by means of a differential scanning calorimeter (DSC) under the heating and cooling conditions 1 defined in the specification, and Tg2 is a glass transition temperature of the toner, as observed in a last heating step, when heating and cooling are performed on the toner by means of the differential scanning calorimeter (DSC) under the heating and cooling conditions 2 defined in the specification.

12 Claims, 1 Drawing Sheet

(52) U.S. Cl.
CPC ..... *G03G 9/08795* (2013.01); *G03G 9/08797* (2013.01); *G03G 15/0865* (2013.01)

(56) References Cited

U.S. PATENT DOCUMENTS

| | | | |
|---|---|---|---|
| 7,374,851 | B2 | 5/2008 | Nakayama et al. |
| 7,455,942 | B2 | 11/2008 | Nagatomo et al. |
| 8,137,087 | B2 | 3/2012 | Norikane et al. |
| 8,252,500 | B2 | 8/2012 | Watanabe et al. |
| 8,546,055 | B2 | 10/2013 | Nakayama et al. |
| 9,141,013 | B2 | 9/2015 | Moriya et al. |
| 2003/0039910 | A1 | 2/2003 | Shirai et al. |
| 2003/0096184 | A1 | 5/2003 | Kawaji et al. |
| 2005/0026064 | A1 | 2/2005 | Sugiura et al. |
| 2005/0089786 | A1 | 4/2005 | Sugiura et al. |
| 2005/0089787 | A1 | 4/2005 | Uchinokura et al. |
| 2005/0208408 | A1 | 9/2005 | Uchinokura et al. |
| 2006/0029433 | A1 | 2/2006 | Saito et al. |
| 2007/0059063 | A1 | 3/2007 | Nakayama et al. |
| 2008/0014527 | A1 | 1/2008 | Kotsugai et al. |
| 2008/0063971 | A1 | 3/2008 | Watanabe et al. |
| 2008/0069606 | A1 | 3/2008 | Yamashita et al. |
| 2008/0233498 | A1 | 9/2008 | Yamada et al. |
| 2008/0268366 | A1 | 10/2008 | Nakayama et al. |
| 2008/0286679 | A1 | 11/2008 | Norikane et al. |
| 2009/0042118 | A1 | 2/2009 | Suzuki et al. |
| 2010/0021209 | A1 | 1/2010 | Watanabe et al. |
| 2010/0055590 | A1 | 3/2010 | Honda et al. |
| 2010/0068644 | A1 | 3/2010 | Nakajima et al. |
| 2010/0136471 | A1 | 6/2010 | Yamada et al. |
| 2011/0065036 | A1 | 3/2011 | Inoue et al. |
| 2012/0028183 | A1 | 2/2012 | Nakajima et al. |
| 2012/0077119 | A1 | 3/2012 | Yoshida et al. |
| 2012/0082926 | A1 | 4/2012 | Suzuki et al. |
| 2012/0129094 | A1 | 5/2012 | Yamauchi et al. |
| 2012/0237868 | A1 | 9/2012 | Yamada et al. |
| 2012/0251168 | A1 | 10/2012 | Nagayama et al. |
| 2012/0258392 | A1* | 10/2012 | Murata ..... G03G 9/0804 430/105 |
| 2012/0288791 | A1 | 11/2012 | Sakashita et al. |
| 2013/0017480 | A1 | 1/2013 | Suzuki et al. |
| 2013/0065172 | A1 | 3/2013 | Moriya et al. |
| 2013/0149642 | A1 | 6/2013 | Sabu et al. |
| 2013/0171550 | A1 | 7/2013 | Amemori et al. |
| 2013/0196263 | A1 | 8/2013 | Asahina et al. |
| 2013/0196266 | A1 | 8/2013 | Watanabe et al. |
| 2013/0202996 | A1 | 8/2013 | Yamauchi et al. |
| 2013/0236826 | A1 | 9/2013 | Makabe et al. |
| 2013/0244162 | A1* | 9/2013 | Yamada ..... G03G 9/08755 430/108.2 |
| 2013/0244167 | A1 | 9/2013 | Yamashita et al. |
| 2013/0252160 | A1 | 9/2013 | Nagayama et al. |
| 2013/0260299 | A1 | 10/2013 | Nakajima et al. |
| 2013/0260302 | A1 | 10/2013 | Nakajima et al. |
| 2013/0330522 | A1 | 12/2013 | Suzuki et al. |
| 2014/0080047 | A1 | 3/2014 | Takahashi et al. |
| 2014/0080050 | A1 | 3/2014 | Asahina et al. |
| 2014/0272690 | A1 | 9/2014 | Suzuki et al. |
| 2014/0342286 | A1 | 11/2014 | Yamauchi et al. |
| 2014/0349231 | A1 | 11/2014 | Shirai et al. |
| 2015/0030819 | A1 | 1/2015 | Naito et al. |
| 2015/0037718 | A1 | 2/2015 | Morita et al. |
| 2015/0037729 | A1 | 2/2015 | Yoshiba et al. |
| 2015/0212444 | A1 | 7/2015 | Yamauchi et al. |
| 2015/0220011 | A1 | 8/2015 | Miyaake et al. |
| 2015/0253685 | A1 | 9/2015 | Suzuki et al. |

FOREIGN PATENT DOCUMENTS

| | | |
|---|---|---|
| JP | 2003-173047 A | 6/2003 |
| JP | 2007-065620 | 3/2007 |
| JP | 2014-232169 | 3/2007 |
| JP | 2009-229920 | 10/2009 |
| JP | 2012-68581 A | 4/2012 |
| JP | 2013-76997 A | 4/2013 |
| JP | 2014-74882 A | 4/2014 |
| JP | 2014-228717 A | 12/2014 |
| JP | 2014-235361 | 12/2014 |
| JP | 2015-45848 A | 3/2015 |

OTHER PUBLICATIONS

International Search Report dated May 31, 2016 for counterpart International Patent Application No. PCT/JP2016/001703 filed Mar. 24. 2016.

Written Opinion dated May 31, 2016 for counterpart International Patent Application No. PCT/JP2016/001703 filed Mar. 24, 2016.

* cited by examiner

[Fig. 1]
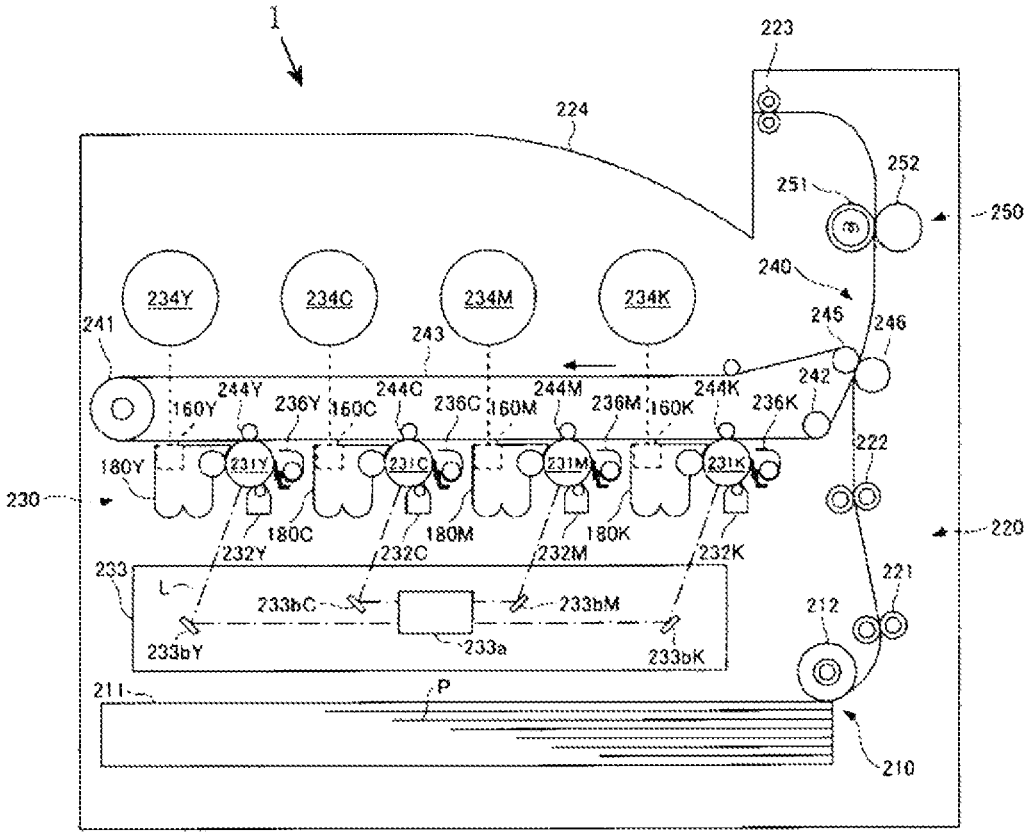
[Fig. 2]
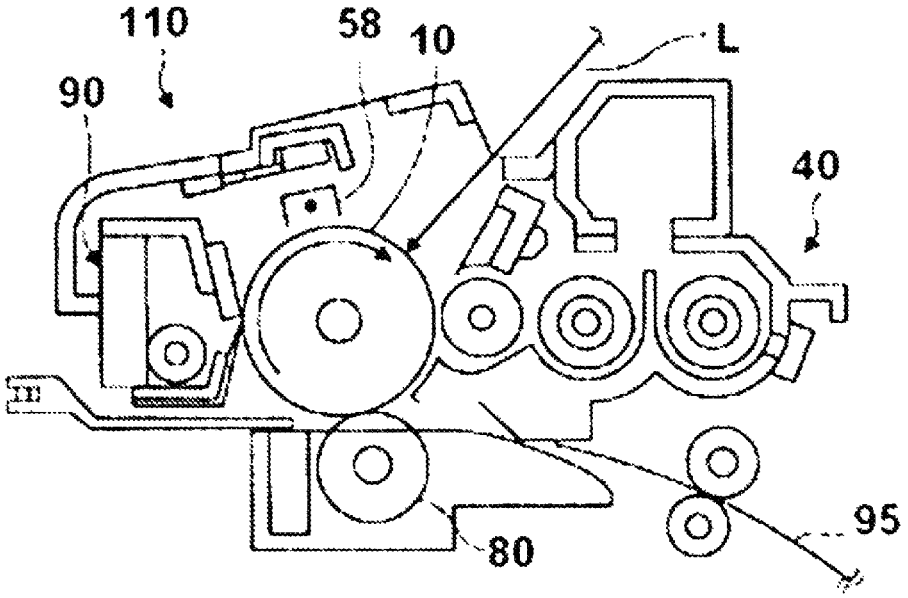

TONER, IMAGE FORMING APPARATUS, AND TONER STORED UNIT

CROSS-REFERENCE TO RELATED APPLICATIONS

This application is a National Stage of PCT/JP2016/001703, which was filed on Mar. 24, 2016. This application is based upon and claims the benefit of priority to Japanese Application No. 2015-160924, which was filed on Aug. 18, 2015, and to Japanese Application No. 2015-086658, which was filed on Apr. 21, 2015.

TECHNICAL FIELD

The present disclosure relates to toners, image forming apparatuses, and toner stored units.

BACKGROUND ART

Image formation by electrophotography is typically performed through a series of processes, where an electrostatic latent image is formed on a photoconductor, the electrostatic latent image is developed with a developer to form a toner image, the toner image is transferred onto a recording medium, such as paper, and the toner image is then fixed on the recording medium.

As for the developer, known are a one-component developer where a magnetic or non-magnetic toner is used independently, and a two-component toner composed of a toner and a carrier.

As for a system for fixing the toner image, a heat roller system is typically used because of excellent energy efficiency thereof. The heat roller system is a system where a heat roller is directly pressed against a toner image present on a recording medium to fix the toner image onto the recording medium.

In case of the heat roller system, however, there is a problem that a large quantity of electricity is required for fixing the toner image. Accordingly, there is a need for improving low-temperature fixing ability of a toner.

The toner disclosed in PTL 1 has a structure where domain phases are present in a matrix formed of a vinyl resin, and each domain phase contains crystalline polyester particles dispersed in a hybrid resin composed of amorphous polyester and a vinyl resin.

Moreover, the toner disclosed in PTL 2 is a toner of a core-shell structure, where the core contains crystalline polyester domains in amorphous polyester, and the shell is formed of amorphous polyester.

Furthermore, the toner disclosed in PTL 3 has a structure containing two kinds of domain phases; i.e., a domain phase of amorphous polyester and a domain phase of crystalline polyester.

CITATION LIST

Patent Literature

PTL 1: Japanese Unexamined Patent Application Publication No. 2014-235361

PTL 2: Japanese Unexamined Patent Application Publication No. 2009-229920

PTL 3: Japanese Unexamined Patent Application Publication No. 2007-065620

SUMMARY OF INVENTION

Technical Problem

As a result of the studies conducted by the present inventors, the following finding has been obtained. Specifically, a matrix resin and a crystalline polyester resin dispersed in the matrix resin are partially compatible to each other in typical toners known to the present inventors, and a diameter of crystalline polyester dispersed in the matrix resin is large. Therefore, the toner has insufficient low-temperature fixing ability, heat-resistant storage stability, and stress resistance under pressure.

The present invention has an object to provide a toner which has excellent low-temperature fixing ability, and excellent heat-resistant storage stability, as well as desirable stress resistance.

Solution to Problem

The structure of the present invention for solving the aforementioned problems is as described in the following (1).

(1) A toner, where a diffraction peak of the toner as measured by X-ray diffraction spectroscopy is present at least in a region where 2θ is from 20° through 25°, and a difference between Tg1 and Tg2 is 10° C. or less, where Tg1 is a glass transition temperature of the toner, as observed in a last heating step, when heating and cooling are performed on the toner by means of a differential scanning calorimeter (DSC) under heating and cooling conditions 1, and Tg2 is a glass transition temperature of the toner, as observed in a last heating step, when heating and cooling are performed on the toner by means of the differential scanning calorimeter (DSC) under heating and cooling conditions 2, the heating and cooling conditions 1 being as follows:

a starting temperature is 20° C., and the toner is heated from the starting temperature to 120° C. at 10° C./min, a temperature of the toner is retained at 120° C. for 10 minutes, the toner is cooled to 0° C. at 10° C./min, and a retention time at 0° C. is none, and the toner is heated to 150° C. at 10° C./min, the heating and cooling conditions 2 being as follows:

a starting temperature is 20° C., and the toner is heated from the starting temperature to 120° C. at 10° C./min, a temperature of the toner is retained at 120° C. for 10 minutes, the toner is cooled to 0° C. at 10° C./min, a retention time at 0° C. is none, and the toner is heated to 45° C. at 10° C./min, and a temperature of the toner is retained at 45° C. for 24 hours, the toner is cooled again to 0° C. at 10° C./min, and a retention time at 0° C. is none, and the toner is heated to 150° C. at 10° C./min.

Advantageous Effects of Invention

The present invention can provide a toner which has excellent low-temperature fixing ability, and excellent heat-resistant storage stability, as well as desirable stress resistance.

BRIEF DESCRIPTION OF DRAWINGS

FIG. 1 is a cross-sectional view illustrating a structure of the image forming apparatus according to the present invention.

FIG. 2 is a cross-sectional view illustrating a structure of a process cartridge, which is one example of the toner stored unit according to the present invention.

DESCRIPTION OF EMBODIMENTS

The present invention is described below in detail.

The crystalline resin causes crystal transition at a melting point thereof and at the same time rapidly reduces the melt viscosity from a solid state thereof, to thereby develop a fixation function on a recording medium.

On the other hand, a melt viscosity of the amorphous resin is gradually reduced from the glass transition temperature thereof. There is a difference of some ten degrees Celsius between the glass transition temperature, and a temperature at which the melt viscosity thereof is reduced sufficiently for developing a fixation function, such as a softening point.

In order to improve low-temperature fixing ability of a toner which contains an amorphous resin but not a crystalline resin, it is necessary to lower the glass transition temperature of the amorphous resin or reduce a molecular weight of the amorphous resin, to thereby reduce a softening point thereof. In this case, however, a resultant toner tends to have insufficient heat-resistant storage stability or hot offset resistance.

Accordingly, combining the crystalline resin with the amorphous resin makes it possible to improve low-temperature fixing ability of a toner without lowering heat-resistant storage stability and hot offset resistance.

The toner of the present invention has the following characteristics.

Accordingly, a diffraction peak of the toner as measured by X-ray diffraction spectroscopy is present at least in a region where 2θ is from 20° through 25°, and a difference in glass transition temperatures of the toner as measured by means of DSC under the following heating and cooling conditions 1 and 2 is 10° C. or less. The difference in the glass transition temperatures is particularly preferably in a range of from 0° C. through 5° C.

(Heating and Cooling Conditions 1)

A starting temperature is 20° C., and the toner is heated from the starting temperature to 120° C. at 10° C./min; a temperature of the toner is retained at 120° C. for 10 minutes; the toner is cooled to 0° C. at 10° C./min; and a retention time at 0° C. is none, and the toner is heated to 150° C. at 10° C./min.

(Heating and Cooling Conditions 2)

A starting temperature is 20° C., and the toner is heated from the starting temperature to 120° C. at 10° C./min; a temperature of the toner is retained at 120° C. for 10 minutes; the toner is cooled to 0° C. at 10° C./min; a retention time at 0° C. is none, and the toner is heated to 45° C. at 10° C./min, and a temperature of the toner is retained at 45° C. for 24 hours; the toner is again cooled to 0° C. at 10° C./min; and a retention time at 0° C. is none, and the toner is heated to 150° C. at 10° C./min.

The toner of the present invention contains a crystalline resin and an amorphous resin. The crystalline resin and the amorphous resin are incompatible to each other in the toner.

The presence of the crystalline resin in the toner can be confirmed by observing a diffraction peak attributed to a crystal segment in X-ray diffraction spectroscopy. The presence of the crystalline polyester in the toner of the present invention can be confirmed, when a diffraction peak is present at least in a region where 2θ is from 20° through 25°, in X-ray diffraction spectroscopy of the toner.

Moreover, whether the crystalline resin and the amorphous resin are incompatible to each other can be judged based on a variation width of the glass transition temperature in DSC.

Specifically, the incompatibility between the crystalline resin and the amorphous resin can be judged based on whether a variation width of the following glass transition temperatures Tg1 and Tg2 is 10° C. or less. Tg1 and Tg2 are glass transition temperatures observed in DSC when the toner, which has not been subjected to a heating and cooling treatment, is treated under the aforementioned heating and cooling conditions 1 and heating and cooling conditions 2.

Tg1: The glass transition temperature of the toner observed in the last heating step, when the toner is subjected to the heating and cooling treatment under the heating and cooling conditions 1.

Tg2: The glass transition temperature of the toner observed in the last heating step, when the toner is subjected to the heating and cooling treatment under the heating and cooling conditions 2.

In the case where the crystalline resin and the amorphous resin are compatible to each other, a glass transition temperature of the toner is significantly reduced, when the toner is melted at 120° C., followed by quenching. As the toner is stored for 24 hours at 45° C. after the quenching, the glass transition temperature is increased again. As a result, the deviation width of the glass transition temperatures Tg1 and Tg2 becomes large.

As described above, a significant reduction in a glass transition temperature of the toner after the production of the toner can be prevented by using the crystalline resin and the amorphous resin that are incompatible to each other. Therefore, excellent heat-resistant storage stability of the toner can be realized.

Moreover, the toner preferably satisfies the following relationship.

$$0.06 \leq M2/(M1+M2) \leq 0.12 \quad \text{[Math. 1]}$$

In the above, M1 is a mass of a toluene-soluble component of the toner, the toluene-soluble component being prepared by adding the toner in toluene and separating the toluene-soluble component from a toluene-insoluble component, and M2 is a mass of a chloroform-soluble component of the toner, the chloroform-soluble component being separated from the toluene-insoluble component.

The toluene-soluble component contains an amorphous resin, and a composite resin, and the chloroform-soluble component separated from the toluene-insoluble component contains crystalline polyester and a release agent.

An amount of the crystalline polyester in the toner is preferably determined depending on an amount of the release agent added into the toner. Specifically, a total amount of the crystalline polyester and the release agent is preferably from 6% by mass through 12% by mass relative to a total amount of the amorphous polyester, the crystalline polyester, the composite resin, and the release agent in the toner. When the total amount of the crystalline resin and the release agent is less than 6% by mass, a sufficient effect of improving low-temperature fixing ability cannot be attained. When the total amount thereof is greater than 12% by mass, dispersibility of the crystalline polyester is poor, which may increase an amount of loose aggregates, and adversely affect a device, as well as impair low-temperature fixing ability.

When a component analysis is performed on the toner by means of a pyrolysis-gas chromatography-mass spectrometer (Py-GC/MS), it is preferable that an acid monomer, an alcohol monomer, and a vinyl monomer be detected.

A monomer composition of the resin contained in the toner can be analyzed by pyrolysis-gas chromatography-mass spectrometry. When at least one acid monomer, at least one alcohol monomer, and at least one vinyl monomer are detected, it is judged that a polyester resin and a vinyl resin are contained.

In the case where a plurality of monomers having the same molecular weight are present, or the case where monomers having substituents at different positions are present in the identification of monomers, a monomer can be analyzed with a fragment pattern (a pattern presenting that an actual monomer is in a state of fragments). Moreover, it is preferable that an acid monomer and an alcohol monomer be detected, and the acid monomer be higher fatty acid having 6 or more carbon atoms and the alcohol monomer be aliphatic alcohol having 6 or more carbon atoms, when a toluene-insoluble component in the toner is separated, a chloroform-soluble component is separated from the separated toluene-insoluble component, and a component analysis is performed on the separated chloroform-soluble component by a pyrolysis-gas chromatography-mass spectrometer (Py-GC/MS).

The chloroform-soluble component separated from the toluene-insoluble component of the toner contains crystalline polyester. As described below, preferably, the acid component of the crystalline polyester is fatty acid having 6 or more carbon atoms, and the alcohol component of the crystalline polyester is aliphatic alcohol having 6 or more carbon atoms.

The amorphous resin is not particularly limited, as long as the amorphous resin can cause phase separation from a crystalline resin. Examples of the amorphous resin include amorphous polyester, amorphous polyurethane, amorphous polyurea, amorphous polyamide, amorphous polyether, an amorphous vinyl resin, amorphous, urethane-modified polyester, and amorphous, urea-modified polyester. One of the above-listed amorphous resins may be used alone, or two or more of the above-listed amorphous resins may be used in combination. Among the above-listed amorphous resins, amorphous polyester is preferable.

The amorphous polyester typically includes a constitutional unit derived from an aromatic compound.

The aromatic compound is not particularly limited, but examples of the aromatic compound include alkylene oxide adducts of bisphenol A, isophthalic acid, terephthalic acid, and derivatives of the aforementioned compounds.

An amount of the constitutional unit derived from the aromatic compound in the amorphous polyester is typically 50% by mass or greater. When the amount of the constitutional unit derived from the aromatic compound in the amorphous polyester is less than 50% by mass, negative-chargeability of a resultant toner may be poor.

A glass transition temperature of the amorphous resin is typically from 45° C. through 75° C., preferably from 50° C. through 70° C. When the glass transition temperature of the amorphous resin is 45° C. or higher, a resultant toner has excellent heat-resistant storage stability. When the glass transition temperature of the amorphous resin is 75° C. or lower, a resultant toner has excellent low-temperature fixing ability.

A softening point of the amorphous resin is typically from 90° C. through 150° C., preferably from 90° C. through 130° C. When the softening point of the amorphous resin is 90° C. or higher, a resultant toner has excellent heat-resistant storage stability. When the softening point of the amorphous resin is 150° C. or lower, a resultant toner has excellent low-temperature fixing ability.

The weight average molecular weight of the amorphous resin is typically from 1,000 through 100,000, preferably from 2,000 through 50,000, and more preferably from 3,000 through 10,000. When the weight average molecular weight of the amorphous resin is 1,000 or greater, a resultant toner has excellent heat-resistant storage stability. When the weight average molecular weight of the amorphous resin is 100,000 or less, a resultant toner has excellent low-temperature fixing ability.

Note that, the weight average molecular weight of the amorphous resin is a molecular weight converted to polystyrene, as measured by gel permeation chromatography.

The crystalline resin includes crystalline polyester. The crystalline polyester may be used in combination with at least one selected from the group consisting of crystalline polyurethane, crystalline polyurea, crystalline polyamide, crystalline polyether, a crystalline vinyl resin, crystalline urethane-modified polyester, and crystalline urea-modified polyester.

The crystalline polyester can be synthesized through polycondensation between polyol and polycarboxylic acid, through ring-opening polymerization of lactone, through polycondensation of hydroxycarboxylic acid, or through ring-opening polymerization of cyclic esters having from 4 through 12 carbon atoms, corresponding to a dehydration condensate between two or three molecules of hydroxycarboxylic acid. Among the above-listed synthesis methods, the crystalline polyester is preferably a polycondensate between diol and dicarboxylic acid.

As for the polyol, diol may be used alone, or diol and trivalent or higher alcohol may be used in combination.

The diol is not particularly limited. Examples of the diol include: aliphatic diol, such as straight-chain aliphatic diol, and branched-chain aliphatic diol; alkylene ether glycol having from 4 through 36 carbon atoms; adducts of alicyclic diol having from 4 through 36 carbon atoms with alkylene oxides (e.g., ethylene oxide, propylene oxide, and butylene oxide) (where the number of moles added is from 1 through 30); adducts of bisphenol with alkylene oxides (e.g., ethylene oxide, propylene oxide, and butylene oxide) (where the number of moles added is from 2 through 30); polylactone diol; polybutadiene diol; and a functional group-containing diol, such as a carboxyl group-containing diol, a sulfonic acid group or sulfamic acid group-containing diol, and diol containing salts thereof. Among the above-listed diol, diol having 6 or more carbon atoms is preferable for reducing the compatibility to the amorphous resin.

An amount of the straight-chain aliphatic diol in the diol is typically preferably 80 mol % or greater, more preferably 90 mol % or greater. When the amount of the straight-chain aliphatic diol in the diol is less than 80 mol %, it may be difficult for a resultant toner to attain both low-temperature fixing ability and heat-resistant storage stability.

Examples of the straight-chain aliphatic diol having from 2 through 36 carbon atoms include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among the above-listed diols, preferable are ethylene glycol, 1,3-propanediol, 1,4-butanediol, 1,6-hexanediol, 1,9-nonanediol, and 1,10-decanediol.

Examples of the branched-chain aliphatic diol having from 2 through 36 carbon atoms include 1,2-propyleneglycol, butanediol, hexanediol, octanediol, decanediol, dodecanediol, tetradecanediol, neopentyl glycol, and 2,2-diethyl-1,3-propanediol.

Examples of the alkylene ether glycol having from 4 through 36 carbon atoms include diethylene glycol, triethylene glycol, dipropylene glycol, polyethylene glycol, polypropylene glycol, and polytetramethylene ether glycol.

Examples of the alicyclic diol having from 4 through 36 carbon atoms include 1,4-cyclohexanedimethanol, and hydrogenated bisphenol A.

Examples of the bisphenol include bisphenol A, bisphenol F, and bisphenol S.

Examples of the polylactone diol include poly(ε-caprolactonediol).

Examples of the carboxyl group-containing diol include dialkylolalkanoic acid having from 6 through 24 carbon atoms, such as 2,2-dimethylolpropionic acid, 2,2-dimethylolbutanoic acid, 2,2-dimethylolheptanoic acid, and 2,2-dimethyloloctanoic acid.

Examples of the sulfonic acid group or sulfamic acid group-containing diol include: N,N-bis(2-hydroxyalkyl)sulfamic acid (where the number of carbon atoms in the alkyl group is from 1 through 6) and adducts thereof with alkylene oxides (e.g., ethylene oxide, propylene oxide, and butylene oxide) (where the number of moles added is from 1 through 6), such as N,N-bis(2-hydroxyethyl)sulfamic acid, and a propylene oxide (2 mol) adduct of N,N-bis(2-hydroxyethyl) sulfamic acid; and bis(2-hydroxyethyl)phosphate.

Examples of a base used for neutralizing salts of the carboxyl group-containing diol and the sulfonic acid group or sulfamic acid group-containing diol include tertiary amine having from 3 through 30 carbon atoms (e.g., trimethylamine), and alkali metal hydroxide (e.g., sodium hydroxide).

Among the above-listed diols, preferable are alkylene glycol having from 2 through 12 carbon atoms, carboxyl group-containing diol, and an alkylene oxide adduct of bisphenol.

The trivalent or higher polyol is not particularly limited. Examples of the trivalent or higher polyol include: alkane polyol, and intramolecular or intermolecular dehydrate thereof, such as glycerin, trimethylolethane, trimethylolpropane, pentaerythritol, sorbitol, sorbitan, and polyglycerin; polyvalent aliphatic alcohol having from 3 through 36 carbon atoms, such as sugars (e.g., sucrose and methyl glucoside), and derivatives thereof; alkylene oxide adducts (where the number of moles added is from 2 through 30) of trisphenol (e.g., trisphenol PA); alkylene oxide adducts (where the number of moles added is from 2 through 30) of a novolak resin (e.g., phenol novolak and cresol novolak); and acryl polyol, such as a copolymer of hydroxyethyl (meth)acrylate and another vinyl monomer.

Among the above-listed polyols, trivalent or higher polyvalent aliphatic alcohol, and an alkylene oxide adduct of a novolak resin are preferable, and the alkylene oxide adduct of a novolak resin is more preferable.

As for the polycarboxylic acid, dicarboxylic acid may be used alone, or dicarboxylic acid and trivalent or higher carboxylic acid may be used in combination.

The dicarboxylic acid is not particularly limited, but examples thereof include: aliphatic dicarboxylic acid, such as straight-chain aliphatic dicarboxylic acid, and branched-chain aliphatic dicarboxylic acid; and aromatic dicarboxylic acid. Among the above-listed dicarboxylic acids, straight-chain aliphatic dicarboxylic acid is preferable.

Examples of the aliphatic dicarboxylic acid include: alkane dicarboxylic acid having from 4 through 36 carbon atoms, such as succinic acid, adipic acid, sebacic acid, azelaic acid, dodecane dicarboxylic acid, octadecane dicarboxylic acid, and decylsuccinic acid; alkene dicarboxylic acid having from 4 through 36 carbon atoms, such as alkenyl succinic acid (e.g., dodecenylsuccinic acid, pentadecenylsuccinic acid, and octadecenylsuccinic acid), maleic acid, fumaric acid, and citraconic acid; and alicyclic dicarboxylic acid having from 6 through 40 carbon atoms, such as dimer acid (e.g., dimerized linoleic acid). Among the above-listed aliphatic dicarboxylic acids, aliphatic dicarboxylic acid having 6 or more carbon atoms is preferable for reducing compatibility to an amorphous resin.

Examples of the aromatic dicarboxylic acid include aromatic dicarboxylic acid having from 8 through 36 carbon atoms, such as phthalic acid, isophthalic acid, terephthalic acid, t-butyl isophthalic acid, 2,6-naphthalenedicarboxylic acid, and 4,4'-biphenyldicarboxylic acid.

The trivalent or higher carboxylic acid is not particularly limited, but examples thereof include aromatic polycarboxylic acid having from 9 through 20 carbon atoms, such as trimellitic acid, and pyromellitic acid.

Instead of the polycarboxylic acid, anhydrides or alkyl esters having from 1 through 4 carbon atoms (e.g., methyl ester, ethyl ester, and isopropyl ester) of the polycarboxylic acid may be used.

Among the above-listed examples, single use of aliphatic dicarboxylic acid is preferable, and single use of adipic acid, sebacic acid, dodecanedicarboxylic acid, terephthalic acid, or isophthalic acid is more preferable. It is also preferable that aliphatic dicarboxylic acid and aromatic dicarboxylic acid be used in combination. Use of aliphatic dicarboxylic acid, and terephthalic acid, isophthalic acid, or t-butyl isophthalic acid in combination is more preferable.

An amount of the aromatic dicarboxylic acid in the polycarboxylic acid is preferably 20 mol % or less.

The lactone is not particularly limited, but examples thereof include monolactone having from 3 through 12 carbon atoms, such as β-propiolactone, γ-butyrolactone, δ-valerolactone, and ε-caprolactone. Among the above-listed lactone, ε-caprolactone is preferable.

At the time of ring-opening polymerization of the lactone, a catalyst (e.g., a metal oxide, and an organic metal compound) may be used, or diol (e.g., ethylene glycol and diethylene glycol) may be used as an initiator.

Examples of a commercial product of a ring-opening polymerized product of the lactone include H1P, H4, H5, H7 of PLACCEL series (available from Daicel Corporation).

The hydroxycarboxylic acid used for the polycondensation is not particularly limited, but examples thereof include glycolic acid and lactic acid (e.g., L-form, D-form, and a racemic body).

The hydroxycarboxylic acid used for the cyclic ester is not particularly limited, but examples thereof include glycolide and lactide (e.g., L-form, D-form, and a racemic body). Among the above-listed hydroxycarboxylic acid, L-lactide and D-lactide are preferable.

At the time of ring-opening polymerization of the cyclic ester, a catalyst (e.g., metal oxide, and an organic metal compound) may be used.

Polyester diol or polyester dicarboxylic acid can be synthesized by modifying a terminal of a polycondensation product of hydroxycarboxylic acid, or a terminal of a ring-opening polymerization product of cyclic ester to be a hydroxyl group or a carboxyl group.

A melting point of the crystalline resin is typically from 60° C. through 110° C., preferably from 70° C. through 100° C. When the melting point of the crystalline resin is 60° C. or higher, a resultant toner has sufficient heat-resistant storage stability. When the melting point of the crystalline resin is 110° C. or lower, a resultant toner has sufficient low-temperature fixing ability.

Note that, the melting point can be measured by means of a differential scanning calorimeter TA-60WS and DSC-60 (available from Shimadzu Corporation). Moreover, the softening point can be measured by means of a flow tester capillary rheometer CFT-500D (available from Shimadzu Corporation).

A softening point of the crystalline resin is typically from 80° C. through 130° C., preferably from 90° C. through 130° C. When the softening point of the crystalline resin is 80° C. or higher, a resultant toner has sufficient heat-resistant storage stability. When the softening point of the crystalline resin is 130° C. or lower, a resultant toner has sufficient low-temperature fixing ability. When the softening point is 90° C. or higher, moreover, a difference between the viscosity of the crystalline resin and the viscosity of the amorphous resin can be made small, hence it is easy to apply shear. As a result, the crystalline resin can be finely dispersed.

When a crystalline resin having a melting point of from 60° C. through 80° C., and a softening point of from 80° C. through 130° C. is synthesized, typically, an aromatic compound is not used, and only an aliphatic compound is used.

A diameter of the dispersed crystalline polyester in the toner is preferably 50 nm or greater but 200 nm or smaller, particularly preferably 50 nm or greater but 100 nm or smaller. When the diameter of the dispersed crystalline polyester is 50 nm or greater but 200 nm or smaller, an interface area between the crystalline polyester and the amorphous polyester is sufficiently ensured, to thereby exhibit an excellent plasticity effect owing to the crystalline polyester. As a result, a resultant toner is sufficiently deformed at the time of fixing, and therefore offset hardly occurs at a low temperature range.

Moreover, as the diameter of the dispersed crystalline polyester increases, a proportion of the crystalline polyester exposed to a surface of a toner particle increases. Because the crystalline polyester has low hardness compared to the amorphous polyester, a resultant toner tends to be affected under pressure. As a result, loose aggregates tend to be generated under pressure, and white missing spots may appear in an image due to the loose aggregates, when such a toner is used in an actual device.

For the aforementioned reasons, the dispersed diameter is preferably made smaller.

The dispersed diameter of the crystalline polyester in the toner can be confirmed by dying with ruthenium tetroxide, followed by observing backscattered electron image with a scanning electron microscope. Because the amorphous polyester is dyed, the amorphous polyester is observed as a bright area in the backscattered electron image. Because the crystalline polyester is not easily dyed, on the other hand, the crystalline polyester is observed as an undyed area (dark area) in the backscattered electron image. The diameter of the crystalline polyester dispersed can be evaluated by observing the difference in contrast between the crystalline polyester and the amorphous polyester.

In the case where the toner contains a composite resin, the composite resin can be distinguished, because the composite resin is dyed with ruthenium tetroxide in the intermediate degree between the amorphous polyester and the crystalline polyester.

(Composite Resin)

In the present invention, a vinyl resin is preferably contained in the toner. It is particularly preferable that the vinyl resin constitute a composite resin with a polyester resin.

The composite resin can function as a dispersing agent for the crystalline polyester, because the solubility parameter of the composite resin of the vinyl resin and the polyester resin falls between the solubility parameter of the crystalline polyester resin and the solubility parameter of the amorphous polyester resin.

In the descriptions below, the polyester resin and the vinyl resin constituting the composite resin may be referred to as a polyester resin segment and a vinyl resin segment, respectively.

The vinyl resin segment contains a constitutional component derived from a bireactive monomer in an amount of 3% by mass or greater but 15% by mass or less, relative to the vinyl resin segment. Note that, a proportion of the vinyl resin in the toner is preferably 20% by mass or less. When the proportion of the vinyl resin is 20% by mass or less, there is no concern regarding insufficient heat-resistant storage stability of a resultant toner due to low Tg of the toner.

(Polyester Segment)

Examples of a carboxylic acid component, which is a raw material monomer of the polyester segment of the composite resin, include aliphatic dicarboxylic acid, aromatic dicarboxylic acid, and trivalent or higher polyvalent carboxylic acid. The carboxylic acid component preferably contains either or both of the aliphatic dicarboxylic acid and the aromatic dicarboxylic acid. Moreover, acid anhydrides or alkyl (where the number of carbon atoms is 1 or more but 3 or less) esters of the above-listed carboxylic acids may be used. As the carboxylic acid component, one of the above-listed carboxylic acids may be used alone, or two or more of the above-listed carboxylic acids may be used in combination.

Specific examples of the aromatic dicarboxylic acid include terephthalic acid, phthalic acid, and isophthalic acid. Among the above-listed examples, terephthalic acid is preferable for the purpose of attaining a toner which has both low-temperature fixing ability and heat-resistant storage stability, and produces a print having excellent bending resistance.

From the same point of view, an amount of the aromatic dicarboxylic acid in the carboxylic acid component is preferably 55 mol % or greater, more preferably 60 mol % or greater, and even more preferably 65 mol % or greater. Moreover, the amount thereof is preferably 80 mol % or less, more preferably 75 mol % or less, and even more preferably 70 mol % or less.

The aliphatic dicarboxylic acid preferably contains aliphatic dicarboxylic acid having from 2 through 6 carbon atoms.

Specific examples of the aliphatic dicarboxylic acid include oxalic acid, malonic acid, maleic acid, fumaric acid, citraconic acid, itaconic acid, glutaconic acid, succinic acid, adipic acid, suberic acid, azelaic acid, sebacic acid, and dodecanedioic acid. Moreover, the examples of the aliphatic dicarboxylic acid also include succinic acid substituted by an alkyl group having from 1 through 20 carbon atoms or an alkenyl group having from 2 through 20 carbon atoms, such as dodecyl succinic acid, dodecenylsuccinic acid, and octenylsuccinic acid. Among the above-listed examples, fumaric acid, dodecenylsuccinic acid, and octenylsuccinic acid are preferable, and fumaric acid is more preferable, for the purpose of attaining a toner, which has both low-temperature fixing ability and heat-resistant storage stability, and produces a print having excellent bending resistance.

From the same point of view, an amount of the aliphatic dicarboxylic acid in the carboxylic acid component is preferably 10 mol % or greater, more preferably 15 mol % or greater, even more preferably 20 mol % or greater, and yet even more preferably 25 mol % or greater. Moreover, the amount thereof is preferably 50 mol % or less, more preferably 45 mol % or less, even more preferably 40 mol % or less, and yet even more preferably 35 mol % or less.

From the same point of view, a molar ratio (aliphatic dicarboxylic acid/aromatic dicarboxylic acid) of the aliphatic dicarboxylic acid to the aromatic dicarboxylic acid is preferably from 20/80 through 50/50, more preferably from 25/75 through 45/55, and even more preferably from 30/70 through 40/60.

For attaining a toner which has both low-temperature fixing ability and heat-resistant storage stability, and produces a print having excellent bending resistance, a total amount of the aliphatic dicarboxylic acid and the aromatic dicarboxylic acid in the carboxylic acid component is preferably 90 mol % or greater, more preferably from 95 mol % through 100 mol %, even more preferably from 99 mol % through 100 mol %, and yet even more preferably 100 mol %.

Examples of an alcohol component, which is a raw material monomer of the polyester segment of the composite resin, include aliphatic diol, aromatic diol, and trivalent or higher polyvalent alcohol. Among the above-listed alcohols, aromatic diol is preferable. As the alcohol component, one of the above-listed alcohols may be used alone or in combination.

The alcohol component of the polyester segment of the composite resin preferably contains an alkylene oxide adduct of bisphenol A, which is represented by the following formula (I), in view of heat-resistant storage stability, durability, and low-temperature fixing ability of a toner.

[Chem. 1]

(I)

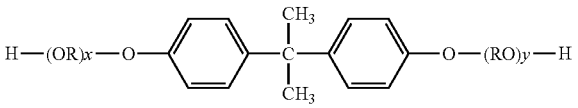

In the formula, R is an alkylene group having 2 or 3 carbon atoms; and x and y are each an average number of moles of the alkyleneoxy group added, and each depict a positive number. The sum of x and y is preferably 1 or greater, more preferably 1.5 or greater, and more preferably 2 or greater, but is preferably 16 or less, more preferably 5 or less, and even more preferably 3 or less.

Specific examples of the alkylene oxide adduct of bisphenol A, which is represented by the formula (I), include polyoxypropylene adducts of 2,2-bis(4-hydroxyphenyl)propane, and polyoxyethylene adducts of 2,2-bis(4-hydroxyphenyl)propane.

In view of heat-resistant storage stability, durability, and low-temperature fixing ability of a toner, the alkylene oxide adduct of bisphenol A, which is represented by the formula (I), is contained in the alcohol component in an amount of preferably from 70 mol % through 100 mol %, more preferably from 80 mol % through 100 mol %, and even more preferably from 90 mol % through 100 mol %.

In view of adjustments of reactivity and physical properties, a ratio of the carboxylic acid component to 100 parts by mol of the alcohol component, which is a raw material monomer of the polyester segment of the composite resin, is preferably 70 parts by mol or greater, more preferably 80 parts by mol or greater, even more preferably 85 parts by mol or greater, and even more preferably 90 parts by mol, but is preferably 110 parts by mol or less, more preferably 100 parts by mol or less, and even more preferably 95 parts by mol or less.

(Vinyl Resin Segment)

Examples of raw material monomers of the vinyl resin segment include: styrene; styrene derivatives, such as α-methylstyrene, and vinyl toluene; alkyl (meth)acrylate; vinyl esters, such as vinyl propionate; ethylenically monocarboxylic acid esters, such as dimethylaminoethyl (meth) acrylate; vinyl ethers, such as vinyl methyl ether; vinylidene halogen compounds, such as vinylidene chloride; and N-vinyl compounds, such as N-vinylpyrrolidone.

In the present specification, the term "(meth)acrylic acid" means at least one of acrylic acid and methacrylic acid.

The vinyl resin segment is preferably a styrene resin for improving compatibility to the crystalline polyester to improve dispersibility of the crystalline polyester in a toner. Such a toner has excellent low-temperature fixing ability, and heat-resistant storage stability, and produces a print having excellent bending resistance. Accordingly, a suitable main raw material monomer of the vinyl resin is preferably styrene, or a styrene derivative, such as α-methylstyrene, and vinyl toluene, and is more preferably styrene.

Note that, the vinyl resin segment contains a constitutional component derived from a bireactive monomer described below. Moreover, raw material monomers of the vinyl resin also contain a bireactive monomer.

For the aforementioned reasons, the lower limit of an amount of the styrene derivative in the raw material monomers of the vinyl resin is preferably 50% by mass or greater, more preferably 60% by mass or greater, even more preferably 70% by mass or greater, and yet even more preferably 75% by mass or greater. Moreover, the upper limit thereof is preferably 97% by mass or less, more preferably 96.8% by mass or less, even more preferably 96.5% by mass or less, yet even more preferably 96% by mass or less, and particularly preferably 85% by mass or less.

As for the styrene resin, a copolymer is preferably used. In view of attaining a toner which has excellent low-temperature fixing ability, and heat-resistant storage stability, and produces a print having excellent bending resistance, the copolymer component is preferably alkyl (meth)acrylate. For the aforementioned reasons, the number of carbon atoms in the alkyl group of the alkyl (meth)acrylate is preferably from 1 through 22, more preferably from 8 through 18.

Note that, the number of carbon atoms of the alkyl ester is the number of carbon atoms derived from an alcohol component constituting the ester. Specific examples of the alkyl (meth)acrylate include methyl (meth)acrylate, ethyl (meth)acrylate, (iso)propyl (meth)acrylate, 2-hydroxyethyl (meth)acrylate, (iso or tertiary)butyl (meth)acrylate, 2-ethylhexyl(meth)acrylate, (iso)octyl (meth)acrylate, (iso)decyl (meth)acrylate, and (iso)stearyl (meth)acrylate. Among the above-listed alkyl (meth)acrylates, 2-ethylhexyl(meth)acrylate is preferable, and 2-ethylhexylacrylate is more preferable. The terms "(iso or tertiary)" and "(iso)" mean to include both a case where the corresponding iso or tertiary group is present, and a case where the corresponding iso or tertiary group is absent. In the case where these groups are absent, the term represents normal (n-). Moreover, the term "(meth)acrylate" includes both acrylate and methacrylate.

For the aforementioned reasons, the lower limit of an amount of the alkyl (meth)acrylate in the raw material monomers of the vinyl resin is preferably 5% by mass or greater, more preferably 10% by mass or greater, even more preferably 15% by mass or greater, and yet even more preferably 18% by mass or greater. Moreover, the upper limit thereof is preferably 40% by mass or less, more preferably 35% by mass or less, even more preferably 30% by mass or less, and yet even more preferably 25% by mass or less.

Note that, a resin obtained through addition polymerization between the styrene derivative and the alkyl (meth) acrylate is also referred to as a styrene-(meth)acryl resin.

For attaining a toner which has excellent low-temperature fixing ability and heat-resistant storage stability, and produces a print having excellent bending resistance, the lower limit of an amount of the raw material monomers of the vinyl resin segment in the raw material monomers of the composite resin is preferably 10 parts by mass or greater, more preferably 20 parts by mass or greater, even more preferably 30 parts by mass or greater, yet even more preferably 40 parts by mass or greater, and particularly preferably 45 parts by mass or greater, relative to 100 parts by mass of the raw material monomers of the polyester segment. Moreover, the upper limit thereof is preferably 75 parts by mass or less, more preferably 70 parts by mass or less, even more preferably 65 parts by mass or less, yet even more preferably 60 parts by mass or less, and particularly preferably 55 parts by mass or less.

(Constitutional Component Derived from Bireactive Monomer)

Examples of a bireactive monomer used in the constitutional component derived from the bireactive monomer include a compound containing, in a molecule thereof, at least one functional group selected from the group consisting of a hydroxyl group, a carboxyl group, an epoxy group, a primary amino group, and a secondary amino group. Among the above-listed bireactive monomers, a compound containing at least one of a hydroxyl group and a carboxyl group, and a compound having an ethylenically unsaturated bond with a carboxyl group is more preferable, in view of reactivity. Use of the aforementioned bireactive monomer can further improve dispersibility of the crystalline polyester.

Specific examples of the bireactive monomer include acrylic acid, methacrylic acid, maleic acid, and maleic anhydride. In view of reactivity of condensation polymerization reaction and addition polymerization reaction, acrylic acid or methacrylic acid is more preferable as the bireactive monomer.

For attaining a toner which has excellent low-temperature fixing ability and heat-resistant storage stability, and produces a print having bending resistance, the lower limit of an amount of the constitutional component derived from the bireactive monomer in the vinyl resin segment of the composite resin is preferably 3% by mass or greater, more preferably 3.2% by mass or greater, even more preferably 3.5% by mass or greater, and yet even more preferably 4% by mass or greater. Moreover, the upper limit thereof is preferably 15% by mass or less, more preferably 10% by mass or less, even more preferably 5% by mass or less, and yet even more preferably 4.5% by mass or less.

(Physical Properties of Composite Resin)

For attaining a toner which has both low-temperature fixing ability and heat-resistant storage stability, and produces a print having excellent bending resistance, the lower limit of a softening point of the composite resin for use in the present invention is preferably 90° C. or higher, more preferably 95° C. or higher, even more preferably 100° C. or higher, yet even more preferably 105° C. or higher, and particularly preferably 110° C. or higher. Moreover, the upper limit of the softening point thereof is preferably 140° C. or lower, more preferably 130° C. or lower, even more preferably 125° C. or lower, yet even more preferably 120° C. or lower, and particularly preferably 115° C. or lower.

From the same point of view, the lower limit of a glass transition temperature of the composite resin for use in the present invention is preferably 50° C. or higher, more preferably 52° C. or higher, and even more preferably 55° C. or higher. Moreover, the upper limit of the glass transition temperature thereof is preferably 75° C. or lower, more preferably 65° C. or lower, and even more preferably 62° C. or lower.

From the same point of view, the lower limit of an acid value of the composite resin is preferably 1 mgKOH/g or greater, more preferably 5 mgKOH/g or greater, even more preferably 10 mgKOH/g or greater, and yet even more preferably 15 mgKOH/g or greater. Moreover, the upper limit of the acid value thereof is preferably 40 mgKOH/g or less, more preferably 35 mgKOH/g or less, even more preferably 20 mgKOH/g or less, and yet even more preferably 18 mgKOH/g or less.

Note that, the softening point, glass transition temperature, and acid value can be easily adjusted by adjusting a composition of raw material monomers, a molecular weight thereof, or an amount of a catalyst, or choice of reaction conditions.

A total amount of the polyester segment, the vinyl resin segment, and the constitutional component derived from the bireactive monomer in the composite resin is preferably 90 mol % or greater, more preferably 95 mol % or greater, even more preferably 99 mol % or greater, and yet even more preferably 100 mol %.

<<Production Method of Composite Resin>>

For example, the composite resin can be produced by the following method.

Specifically, the production method of the composite resin is a method containing: (A) performing a condensation polymerization reaction between an alcohol component and a carboxylic acid component, followed by (B) performing an addition polymerization reaction of raw material monomers of a vinyl resin segment, and optionally a bireactive monomer. In view of reactivity, the bireactive monomer is preferably supplied to a reaction system together with other raw material monomers of the vinyl resin segment.

In view of reactivity, moreover, a catalyst, such as an esterification catalyst and an esterification accelerator, may be used. Moreover, a polymerization initiator and a polymerization inhibitor may be used.

The aforementioned method is preferably performed in one container.

A temperature of the condensation polymerization reaction is preferably 220° C. or higher, more preferably 225° C. or higher, and even more preferably 230° C. or higher, but is preferably 245° C. or lower, more preferably 240° C. or lower, and even more preferably 238° C. or lower.

A temperature of the addition polymerization reaction is preferably 120° C. or higher, more preferably 140° C. or higher, even more preferably 160° C. or higher, and yet even more preferably 200° C. or higher, but is preferably 235° C. or lower, more preferably 230° C. or lower, even more preferably 225° C. or lower, and yet even more preferably 220° C. or lower.

Moreover, the reaction is preferably accelerated by reducing the pressure of the reaction system in the latter-half of the polymerization.

(Esterification Catalyst)

As for the esterification catalyst suitably used for the condensation polymerization, the same esterification catalyst used for the production of the crystalline polyester can be suitably used.

Examples of the esterification catalyst suitably used for the condensation polymerization include titanium compounds, and tin(II) compounds free from Sn—C bonds. One of the above-listed esterification catalysts may be used alone, or two or more of the above-listed esterification catalysts may be used in combination.

The titanium compound is preferably a titanium compound including a Ti—O bond, preferably a compound containing an alkoxy group having from 1 through 28 carbon atoms, an alkenyloxy group having from 1 through 28 carbon atoms, or an acyloxy group having from 1 through 28 carbon atoms.

Preferable examples of the tin(II) compound free from Sn—C bonds include a tin(II) compound containing a Sn—O bond, and a tin(II) compound containing a Sn—X bond (X is a halogen atom). The tin(II) compound free from Sn—C bonds is more preferably a tin(II) compound containing a Sn—O bond. Among the above-listed examples, tin(II) di(2-ethylhexanoate) is even more preferable, in view of reactivity, adjustment of a molecular weight, and adjustment of physical properties of the resin.

In view of reactivity, adjustment of a molecular weight, and adjustment of physical properties of the resin, the abundance of the esterification catalyst relative to 100 parts by mass of a total amount of the alcohol component and the carboxylic acid component is preferably 0.1 parts by mass or greater, more preferably 0.2 parts by mass or greater, even more preferably 0.3 parts by mass or greater, and yet even more preferably 0.5 parts by mass or greater, but is preferably 3 parts by mass or less, more preferably 2 parts by mass or less, and even more preferably 1 part by mass or less.

(Esterification Accelerator)

As for the esterification accelerator, the same esterification accelerator used for the production of the crystalline polyester can be suitably used. The esterification accelerator is preferably gallic acid in view of reactivity.

In the case where the esterification accelerator is used, the abundance of the esterification accelerator in the condensation polymerization reaction relative to 100 parts by mass of a total amount of the alcohol component and carboxylic acid component supplied to the condensation polymerization reaction is, in view of reactivity, preferably 0.001 parts by mass or greater, more preferably 0.01 parts by mass or greater, and even more preferably 0.02 parts by mass or greater, but is preferably 0.1 parts by mass or less, more preferably 0.05 parts by mass or less, and even more preferably 0.03 parts by mass or less. In the present specification, the abundance of the esterification accelerator means a total amount of the esterification promotor supplied for the condensation polymerization reaction.

In view of reactivity, a mass ratio (esterification accelerator/esterification catalyst) of the esterification accelerator to the esterification catalyst is preferably 0.01 or greater, more preferably 0.02 or greater, and even more preferably 0.03 or greater, but is preferably 0.1 or less, more preferably 0.08 or less, and even more preferably 0.05 or less.

The toner may further contain a release agent (wax), a colorant, a charge-controlling agent, and a flow improving agent.

The release agent is not particularly limited, but examples of the release agent include solid silicone wax, higher fatty acid, higher alcohol, montan-based ester wax, polyethylene wax, and polypropylene wax. The above-listed release agents may be used in combination. In view of finely dispersing the release agent in the toner, free-fatty acid carnauba wax, montan wax, and oxidized rice wax are exemplified. The above-listed waxes may be used in combination.

The carnauba wax is fine crystals, and preferably has an acid value of 5 mgKOH/g or less.

The montan wax typically means montan-based wax purified from minerals, and preferably has an acid value of from 5 mgKOH/g through 14 mgKOH/g.

The oxidized rice wax is air-oxidized rice bran wax, and preferably has an acid value of from 10 mgKOH/g through 30 mgKOH/g.

The glass transition temperature of the release agent is typically preferably from 70° C. through 90° C. When the glass transition temperature of the release agent is lower than 70° C., heat-resistant storage stability of a resultant toner may be poor. When the glass transition temperature of the release agent is higher than 90° C., cold offset resistance of a resultant toner may be poor, or paper may be wrapped around a fixing device.

A mass ratio of the release agent to the binder resin is typically from 0.01 through 0.20, preferably from 0.03 through 0.10. When the mass ratio of the release agent to the binder resin is less than 0.01, a resultant toner may have poor hot offset resistance. When the mass ratio of the release agent to the binder resin is greater than 0.20, a resultant toner may have poor transferring properties and durability.

The colorant is not particularly limited, as long as the colorant is a pigment or a dye. Examples of the colorant include: yellow pigments, such as cadmium yellow, mineral fast yellow, nickel titanium yellow, Naples yellow, Naphthol Yellow S, Hansa Yellow G, Hansa Yellow 10G, Benzidine Yellow GR, quinoline yellow lake, Permanent Yellow NCG, and tartrazine lake; orange pigments, such as molybdate orange, Permanent Orange GTR, pyrazolone orange, Vulcan orange, Indanthrene Brilliant Orange RK, benzidine orange G, and Indanthrene Brilliant Orange GK; red pigments, such as red iron oxide, cadmium red, Permanent Red 4R, lithol red, pyrazolone red, watching red calcium salt, Lake Red D, Brilliant Carmine 6B, eosin lake, Rhodamine Lake B, alizarin lake, and Brilliant Carmine 3B; purple pigments, such as Fast Violet B, and methyl violet lake; blue pigments, such as cobalt blue, alkali blue, Victoria blue lake, phthalocyanine blue, metal-free phthalocyanine blue, partially chlorinated phthalocyanine blue, fast sky blue, and Indanthrene Blue BC; green pigments, such as chrome green, chromium oxide, Pigment Green B, and malachite green lake; black pigments, such as carbon black, oil furnace black, channel black, lamp black, acetylene black, azine dyes (e.g., aniline black), metal salts of azo dyes, metal oxides, and composite metal oxides. The above-listed colorants may be used in combination.

The charge-controlling agent is not particularly limited. Examples of the charge-controlling agent include: nigrosine, and azine dyes containing an alkyl group having from 2 through 16 carbon atoms (Japanese Examined Patent Publication No. 42-1627); basic dyes and lake pigments thereof, such as C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25

(C.I. 52025), C.I. Basic Blue 26 (C.I. 44045), C.I. Basic Green 1 (C.I. 42040), and C.I. Basic Green 4 (C.I. 42000); quaternary ammonium salts, such as C.I. Solvent Black 8 (C.I. 26150), benzoylmethylhexadecyl ammonium chloride, and decyltrimethyl chloride; dialklyl tin, such as dibutyl tin, and dioctyl tin; dialkyl tin borate compounds; polyamine resins, such as guanidine derivatives, amino-group containing vinyl polymers, and amino group-containing condensation polymers; metal complex salts of monoazo dyes disclosed in Japanese Examined Patent Publication Nos. 41-20153, 43-27596, 44-6397, and 45-26478, and salicylic acid disclosed in Japanese Examined Patent Publication Nos. 55-42752, and 59-7385; dialkyl salicylate, naphthoic acid, metal (e.g., Zn, Al, Co, Cr, and Fe) complexes of dicarboxylic acid, sulfonated copper phthalocyanine pigments, organic boron salts, fluorine-containing quaternary ammonium salts, and calixarene-based compounds. The above-listed examples may be used in combination.

A material constituting the flow improving agent is not particularly limited, but examples of the material include silica, alumina, titanium oxide, barium titanate, magnesium titanate, calcium titanate, strontium titanate, zinc oxide, silica sand, montmorillonite, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. The above-listed materials may be used in combination. Among the above-listed materials, silica, alumina, titanium oxide are preferable.

The flow improving agent preferably contains a silicon element constituting a silicon compound, such as silica, and optionally a metal element (a dope compound).

The metal element is not particularly limited, but examples of the metal element include Mg, Ca, Ba, Al, Ti, Ti, V, Sr, Zr, Zn, Ga, Ge, Cr, Mn, Fe, Co, Ni, and Cu.

The flow improving agent may be surface-treated with a hydrophobizing agent.

The hydrophobizing agent is not particularly limited, but examples thereof include a silane coupling agent, a sililation agent, a fluoroalkyl group-containing silane coupling agent, an organic titanate-based coupling agent, an aluminium-based coupling agent, and silicone oil.

An amount of the flow improving agent in the toner is typically from 0.1% by mass through 5% by mass.

The average primary particle diameter of the flow improving agent is typically from 5 nm through 1,000 nm, preferably from 5 nm through 500 nm.

Note that, the average primary particle diameter of the flow improving agent is an average value of long diameters of 100 particles or more, as measured by means of a transmission electron microscope.

The toner of the present invention preferably has a melting point in a range of from 70° C. through 100° C. When the melting point of the toner is 70° C. or higher, sufficient heat-resistant storage stability of a resultant toner is attained. When the melting point of the toner is 100° C. or lower, sufficient low-temperature fixing ability of a resultant toner is attained. The melting point of the toner is attributed to the crystalline resin contained in the toner.

Moreover, the glass transition temperature of the toner is preferably 55° C. or higher for ensuring heat-resistant storage stability of the toner.

Moreover, a softening point measured on a chloroform-soluble component is preferably 90° C. or higher, where the chloroform-soluble component is prepared by separating the toluene-insoluble component in the toner and separating the chloroform-soluble component from the toluene-insoluble component.

The chloroform-soluble component separated from the toluene-insoluble component contains a crystalline resin. When the softening point is 90° C. or higher, sufficient heat-resistant storage stability of a resultant toner is ensured. Moreover, a difference between the viscosity of the crystalline resin and the viscosity of the amorphous resin can be made small, hence it is easy to apply shear. This makes it possible to finely disperse the crystalline resin.

A weight average particle diameter (D4) of the toner is typically from 3 μm through 8 μm, preferably from 4 μm through 7 μm.

A ratio of the weight average particle diameter (D4) of the toner to a number average particle diameter (D1) of the toner is typically from 1.00 through 1.40, preferably from 1.05 through 1.30.

Note that, the number average particle diameter (D1) and the weight average particle diameter (D4) of the toner can be measured by the Coulter Counter method.

(Image Forming Apparatus and Image Forming Method)

An image forming apparatus of the present invention includes at least a photoconductor, a charging unit configured to charge the photoconductor, an exposing unit configured to expose the photoconductor charged to light to form an electrostatic latent image, a developing unit configured to develop the electrostatic latent image formed on the photoconductor with the developer of the present invention to form a toner image, a transfer unit configured to transfer the toner image to a recording medium, and a fixing unit configured to fix the toner image transferred on the recording medium. The image forming apparatus may further include other units, if necessary.

An image forming method according to the present invention includes at least a charging step, an exposure step, a developing step, a transfer step, and a fixing step. The image forming method may further include other steps, if necessary.

<Photoconductor>

A material, structure, and size of the photoconductor are not particularly limited, and are appropriately selected from those known in the art. Examples of the material of the photoconductor include: inorganic photoconductors, such as amorphous silicon and selenium; and organic photoconductors, such as polysilane and phthalopolymethine. Among the above-listed materials, amorphous silicon is preferable in view of a long service life thereof.

<<Charging Unit and Charging Step>>

The charging unit is appropriately selected depending on the intended purpose without any limitation. Examples of the charging unit include conventional contact chargers, equipped with a conductive or semiconductive roller, brush, film, or rubber blade, and non-contact chargers utilizing corona discharge, such as corotron, and scorotron.

The charging step can be performed by applying voltage to a surface of the photoconductor using the charging unit.

As for a shape of the charging unit, in addition to a roller, any form, such as a magnetic brush, and a fur brush, can be used. The shape of the charging unit can be selected depending on specifications and forms of the image forming apparatus.

The charging unit is not limited to the contact charging unit. Use of the contact charging unit is however preferable, because it is possible to attain an image forming apparatus in which an amount of ozone generated from the charging unit is reduced.

<<Exposing Unit and Exposing Step>>

The exposing unit is appropriately selected depending on the intended purpose without any limitation, except that the exposing unit is capable of imagewise exposing the charged surface of the photoconductor by the charging unit to light. Examples of the exposing unit include various exposing units, such as a copy optical system, a rod lens array system, a laser optical system, and a liquid crystal shutter optical system.

A light source used in the exposing unit is appropriately selected depending on the intended purpose without any limitation. Examples of the light source include common light-emitting devices such as a fluorescent lamp, a tungsten lamp, a halogen lamp, a mercury lamp, a sodium lamp, a light-emitting diode (LED), a laser diode (LD) and an electroluminescence (EL).

Also, various filters such as a sharp-cut filter, a band-pass filter, an infrared cut filter, a dichroic filter, an interference filter and a color conversion filter may be used for emitting only light having a desired wavelength range.

For example, the exposing step can be performed by imagewise exposing the surface of the photoconductor to light using the exposing unit.

Note that, in the present invention, a back-exposure system may be employed. The back-exposure system is a system where the photoconductor is imagewise exposed to light from the back side of the photoconductor.

<<Developing Unit and Developing Step>>

The developing unit is appropriately selected depending on the intended purpose without any limitation, except that the developing unit includes a toner, with which the electrostatic latent image formed on the photoconductor is developed to form a toner image that is a visible image.

The developing step is appropriately selected depending on the intended purpose without any limitation, except that the developing step includes developing the electrostatic latent image formed on the photoconductor with the toner to form a toner image that is a visible image. For example, the developing step can be performed by the developing unit.

The developing unit is preferably a developing device, which contains a stirring device configured to stir the toner to cause friction and charge the toner, and a developer bearing member containing a magnetic-field generating unit fixed inside the developer bearing member, and being configured to bear a developer containing the toner on a surface of the developer bearing member.

<<Transfer Unit and Transfer Step>>

The transfer unit is appropriately selected depending on the intended purpose without any limitation, except that the transfer unit is a member configured to transfer the visible image onto a recording medium. A preferable embodiment of the transfer unit is a transfer unit that contains a primary transfer unit configured to transfer visible images on an intermediate transfer member to form a composite transfer image, and a secondary transfer unit configured to transfer the composite transfer image onto a recording medium.

The transfer step is appropriately selected depending on the intended purpose without any limitation, except that the transfer step contains transferring the visible image onto a recording medium. A preferable embodiment of the transfer step is a step containing primarily transferring the visible image onto an intermediate transfer member and secondarily transferring the visible image onto the recording medium.

For example, the transfer step can be performed by charging the photoconductor using a transfer charger to transfer the visible image, and can be performed by the transfer unit.

In the case where an image secondary transferred onto the recording medium is a color image composed of toners of a plurality of colors, a toner of each color is sequentially overlapped on the intermediate transfer member to form an image on the intermediate transfer member, and the superimposed image on the intermediate transfer member is secondary transferred on the recording medium at once by the intermediate transfer unit.

Note that, the intermediate transfer member is appropriately selected from conventional transfer members depending on the intended purpose without any limitation. Examples of the intermediate transfer member suitably include a transfer belt.

The transfer unit (the primary transfer unit and the secondary transfer unit) preferably includes at least a transfer device configured to charge the visible image to release the visible image formed on the photoconductor to the side of the recording medium. Examples of the transfer device include a corona transfer device using corona discharge, a transfer belt, a transfer roller, a press transfer roller, and an adhesion transfer device.

Note that, the recording medium is typically plain paper, but the recording medium is appropriately selected depending on the intended purpose without any limitation, except that an unfixed image after developing can be transferred onto the recording medium. As for the recording medium, a PET base for OHP can also be used.

<<Fixing Unit and Fixing Step>>

The fixing unit is appropriately selected depending on the intended purpose without any limitation, except that the fixing unit is a member configured to fix the transferred image on the recording medium. The fixing unit is preferably a conventional heat pressure member. Examples of the heat pressure member include a combination of a heat roller, and a press roller, and a combination of a heat roller, a press roller, and an endless belt.

The fixing step is appropriately selected depending on the intended purpose without any limitation, except that the fixing step contains fixing the visible image transferred on the recording medium. For example, the fixing step may be performed every time the toner image composed of the toner of each color is transferred onto the recording medium. Alternatively, the fixing step may be performed once on a state where toner images of the toners of all colors are laminated.

The fixing step can be performed by the fixing unit.

The heating by the heat pressure member is typically preferably performed at a temperature range of from 80° C. through 200° C.

Note that, in the present invention, a conventional optical fixing device may be used in combination with or instead of the fixing unit, depending on the intended purpose.

The contact pressure in the fixing step is appropriately selected depending on the intended purpose without any limitation, but the contact pressure is preferably from 10 $N/cm^2$ through 80 $N/cm^2$.

<<Developer>>

A developer of the present invention includes at least the toner, and may further include appropriately selected other components, such as a carrier, if necessary.

In the case where the developer is used in a high-speed printer corresponding to an improved information processing speed of recent years, a two-component developer containing a toner and a carrier is preferably used, because a service life is improved.

<<<Carrier>>>

The carrier is appropriately selected depending on the intended purpose without any limitation, but the carrier is preferably a carrier which contains carrier particles each containing a core, and a resin layer covering the core.

A material of the core is appropriately selected depending on the intended purpose without any limitation. Examples of the material include a manganese-strontium-based material of from 50 emu/g through 90 emu/g, and a manganese-magnesium-based material of from 50 emu/g through 90 emu/g. In order to ensure a desired image density, moreover, a high magnetic material, such as iron powder (100 emu/g or greater) and magnetite (from 75 emu/g through 120 emu/g), is preferably used. Moreover, a low magnetic material, such as a copper/zinc-based material of from 30 emu/g through 80 emu/g, is preferably used, because an impact of the developer in the form of a brush to the photoconductor can be weakened, and a high quality image can be formed.

The volume average particle diameter of the cores is appropriately selected depending on the intended purpose without any limitation, but the volume average particle diameter thereof is preferably from 10 μm through 150 μm, more preferably from 40 μm through 100 μm.

When the volume average particle diameter is smaller than 10 μm, an amount of fine powder in the carrier increases to reduce magnetization per particle, and thus scattering of the carrier may be caused. When the volume average particle diameter is greater than 150 μm, a specific surface area of the carrier as a whole decreases, to thereby cause toner scattering. When a full-color image having a large solid image area is formed, moreover, reproducibility of, particularly, the solid image area may be poor.

In the case where the toner is used for a two-component developer, the toner is mixed in use with the carrier. An amount of the carrier in the two-component developer is appropriately selected depending on the intended purpose without any limitation. The amount of the carrier relative to 100 parts by mass of the two-component developer is preferably from 90 parts by mass through 98 parts by mass, more preferably from 93 parts by mass through 97 parts by mass.

The developer of the present invention can be suitably used for image formation performed by various conventional electrophotographic methods, such as a magnetic one-component developing method, a non-magnetic one-component developing method, and a two-component developing method.

For example, inside the developing unit, the toner and the carrier are mixed and stirred, and the toner is charged by the frictions caused during the mixing and stirring. As a result, the toner is held on a surface of a rotating magnetic roller in the form of a brush, to thereby form a magnetic brush. The magnet roller is disposed adjacent to the photoconductor.

Part of the toner constituting the magnetic brush formed on the surface of the magnetic roller is moved onto the surface of the photoconductor by an electrical suction force. As a result, the electrostatic latent image is developed with the toner, and a visible image formed of the toner is formed on the surface of the photoconductor.

<Other Units and Other Steps>

Examples of the other units include a cleaning unit, a charge eliminating unit, a recycling unit, and a controlling unit.

Examples of the other steps include a cleaning step, a charge eliminating step, a recycling step, and a controlling step.

<<Cleaning Unit and Cleaning Step>>

The cleaning unit is appropriately selected depending on the intended purpose without any limitation, except that the cleaning unit is a unit capable of removing the toner remaining on the photoconductor. Examples of the cleaning unit include a magnetic brush cleaner, an electrostatic brush cleaner, a magnetic roller cleaner, a blade cleaner, a brush cleaner, and a wave cleaner.

The cleaning step is appropriately selected depending on the intended purpose without any limitation, except that the cleaning step is a step capable of removing the toner remaining on the photoconductor. For example, the cleaning step can be performed by the cleaning unit.

<<Charge Eliminating Unit and Charge Eliminating Step>>

The charge eliminating unit is appropriately selected depending on the intended purpose without any limitation, except that the charge eliminating unit is a unit configured to apply a charge eliminating bias to the photoconductor for charge elimination. Examples of the charge eliminating unit include a charge eliminating lamp.

The charge eliminating step is appropriately selected depending on the intended purpose without any limitation, except that the charge eliminating step is a step including applying a charge eliminating bias to the photoconductor for charge elimination. For example, the charge eliminating step can be performed by the charge eliminating unit.

<<Recycling Unit and Recycling Step>>

The recycling unit is appropriately selected depending on the intended purpose without any limitation, except that the recycling unit is a unit configured to recycle the toner removed by the cleaning unit into the developing device. Examples of the recycling unit include conventional conveying units.

The recycling step is appropriately selected depending on the intended purpose without any limitation, except that the recycling step is a step containing recycling the toner removed by the cleaning unit into the developing device. For example, the recycling step can be performed by the recycling unit.

Next, one embodiment for carrying out a method for forming an image using the image forming apparatus of the present invention will be described with reference to FIG. 1.

An image forming apparatus 1 is a printer, but the image forming apparatus is not particularly limited as long as an image can be formed with a toner, and may be a photocopier, a facsimile, or a multifunction peripheral.

The image forming apparatus 1 contains a paper feeding unit 210, a conveying unit 220, an image forming unit 230, a transfer unit 240, and a fixing device 250.

The paper feeding unit 210 contains a paper feeding cassette 211 loaded with a pile of paper P to be fed, and a paper feeding roller 212 configured to feed the paper P in the paper feeding cassette 211 one sheet at a time.

The conveying unit 220 contains a roller 221 configured to transport the paper P fed by the paper feeding roller 212 to the direction of the transfer unit 240, a pair of timing rollers 222 configured to nip the edge of the paper P transported by the roller 221 to stand by, and to send the paper to the transfer unit 240 at a predetermined timing, and a paper ejecting roller 223 configured to eject the paper P, on which a color toner image has been fixed, onto a paper ejecting tray 224.

The image forming unit 230 contains, from the left to right in the drawing, an image forming unit Y configured to form an image using a developer containing a yellow toner, an image forming unit C using a developer containing a cyan toner, an image forming unit M using a developer containing a magenta toner, and an image forming unit K using a developer containing a black toner, with predetermined spaces between the aforementioned image forming units and an exposure device 233.

When any image forming unit is referred to among the image forming units (Y, C, M, and K), it is merely indicated as an image forming unit.

Moreover, the developer contains a toner and a carrier.

The four image forming units (Y, C, M, and K) use mutually different developers, but mechanical structures thereof are substantially the same.

The transfer unit 240 contains a driving roller 241 and a driven roller 242, an intermediate transfer belt 243 capable of rotating counterclockwise in the drawing, along the movement of the driving roller 241, primary transfer rollers (244Y, 244C, 244M, and 244K) disposed to face the photoconductor drum 231 via the intermediate transfer belt 243, and a secondary counter roller 245 and a secondary transfer roller 246 disposed to face each other via the intermediate transfer belt 243 in a transferring position where a toner image is transferred to paper.

A heater is disposed inside the fixing device 250. The fixing device 250 contains a fixing belt 251 configured to heat the paper P, and a press roller 252 configured to rotatably press the fixing belt 251 to form a nip. With the above structure, heat and pressure are applied on a color toner image on the paper P to thereby fix the color toner image. The paper P, on which the color toner image has been fixed, is ejected onto the paper ejecting tray 224 by the paper ejecting roller 223, to thereby complete a series of image formation processes.

(Toner Stored Unit)

A toner stored unit of the present invention is a unit which has a function of storing a toner and stores a toner.

Examples of the toner stored unit include a toner container, a developing device, and a process cartridge.

The toner container refers to a container storing a toner therein.

The developing device refers to a unit storing a toner therein and configured to perform development.

The process cartridge refers to an integrated unit of at least an image bearer (also referred to as a photoconductor) and a developing unit, and is detachably mounted in an image forming apparatus. The process cartridge may further contain at least one selected from the group consisting of a charging unit, an exposing unit, and a cleaning unit.

When the toner stored unit of the present invention is mounted in an image forming apparatus, the image forming apparatus can perform image formation with taking advantage of the features of the toner that has excellent low-temperature fixing ability, and excellent heat-resistant storage stability, as well as desirable stress resistance.

<Process Cartridge>

A process cartridge of the present invention is designed to be detachably mounted in various image forming apparatuses, and includes at least a photoconductor configured to bear an electrostatic latent image, and a developing unit configured to develop the electrostatic latent image born on the photoconductor with the developer of the present invention to form a toner image. Note that, the process cartridge of the present invention may further include other members, if necessary.

The developing unit contains at least a developer container housing therein the developer of the present invention, and a developer bearing member configured to bear the developer housed in the developer container and convey the developer. Note that, the developing unit may contain a regulating member configured to regulate a thickness of the developer born on the developer bearing member.

One example of the process cartridge of the present invention is illustrated in FIG. 2. The process cartridge 110 includes a photoconductor drum 10, a corona charger 58, a developing device 40, a transfer roller 80, and a cleaning device 90.

EXAMPLES

The present invention will next be described in more detail by way of Examples, but the Examples shall not be construed to limit the scope of the present invention thereto. Note that, the unit "part(s)" denotes "part(s) by mass."

(Glass Transition Temperature and Melting Point)

A glass transition temperature and a melting point were measured by means of a thermal analysis workstation, TA-60WS and a differential scanning calorimeter, DSC-60 (available from Shimadzu Corporation) under the following conditions.

Sample container: aluminium sample pan (with a lid)
Amount of sample: 5 mg
Reference: aluminium sample pan (alumina 10 mg)
Atmosphere: nitrogen (flow rate: 50 mL/min)

Note that, in the present invention, heating and cooling conditions are varied depending on the intended purpose.

At the time of analysis of the resins and toners in Production Examples and Examples, the measurement was performed under the following conditions, unless otherwise stated.

Starting temperature: 20° C.
Heating speed: 10° C./min
Ending temperature: 150° C.
Retention time: none
Cooling speed: 10° C./min
Ending temperature: 20° C.
Retention time: none
Heating speed: 10° C./min
(The Glass Transition Temperature Observed in this Heating Step was Employed.)
Ending temperature: 150° C.

The heating and cooling conditions 1 and the heating and cooling conditions 2 specified in the present invention are as follows.

(Heating and Cooling Conditions 1)
Starting temperature: 20° C.
Heating speed: 10° C./min
Ending temperature: 120° C.
Retention time: 10 min
Cooling speed: 10° C./min
Ending temperature: 0° C.
Retention time: none
Heating speed: 10° C./min
(The Glass Transition Temperature Observed in this Heating Step was Employed.)
Ending temperature: 150° C.
(Heating and Cooling Conditions 2)
Starting temperature: 20° C.
Heating temperature: 10° C./min
Ending temperature: 120° C.
Retention time: 10 min
Cooling speed: 10° C./min
Ending temperature: 0° C.
Retention time: none
Heating speed: 10° C./min
Ending temperature: 45° C.
Retention time: 24 h Cooling speed: 10° C./min Ending temperature: 0° C.

Retention time: none

Heating speed: 10° C./min (The Glass Transition Temperature Observed in this Heating Step was Employed.)

Ending temperature: 150° C.

The measurement results were analyzed by means of data analysis software, TA-60, version 1.52 (available from Shimadzu Corporation). The glass transition temperature or the melting point in the DSC curve can be judged based on whether there is a change in a base line before and after heat absorption at the time of heating. The base line changes for the glass transition temperature, but not for the melting point. The glass transition temperature was defined with an onset temperature, but the glass transition temperature was calculated by the following method. Specifically, the minimum peak temperature, and the minimum peak minus 10° C. on the DrDSC curve, which was the DSC differential curve for heating, were designated, and the glass transition temperature was calculated using a tangent intersection calculation function of an analysis software. Moreover, the melting point was calculated by determining the endothermic peak temperature without causing a change in the base line.

(Softening Point)

A softening point was measured by means of a flow tester capillary rheometer, CFT-500D (available from Shimadzu Corporation). Specifically, a load of 1.96 MPa was applied to a sample (1 g) by a plunger with heating the sample at the heating speed of 6° C./min, to push out the sample from a nozzle having a diameter of 1 mm and a length of 1 mm. The dropped amount of the plunger of the flow tester relative to the temperature was plotted. The temperature at which a half of the sample was flown out was determined as a softening point.

(X-Ray Diffraction Peak)

An X-ray diffraction peak was observed by means of the following device under the following measuring conditions.

X-ray diffraction device: D8 ADVANCE, available from Bruker AXS

X-ray source: Cu-Kα line (wavelength: 0.15418 nm)

Output: 40 kV, 40 mA

Slit system: slit DS, SS=1°, RS=0.2 mm

Measurement range: 2θ=from 5° through 60°

Step gap: 0.02°

Scanning speed: 1°/min (Average Diameter of Undyed Areas)

The toner particles were embedded in an epoxy resin, followed by slicing the epoxy resin into an ultrathin cut piece of about 100 nm. The cut piece was then dyed with ruthenium tetroxide. A backscattered electron image thereof was observed by means of a thermal FE-SEM (ULTRA55, available from Zeiss) with the accelerating voltage of 0.8 kV. Because the undyed area was observed as a dark area, the undyed area could be distinguished from the dyed area (bright area).

The toner for use may be the toner with external additive, or the toner without external additive, or the toner from which external additive has been removed.

A cross-section of the toner particle was dyed with a 0.5% by weight ruthenium tetroxide aqueous solution, followed by observing the cross-section under a scanning electron microscope (SEM) under reflected electron conditions. The average diameter was measured from the contrast in color in the cross-section of the toner particle.

Note that, as for the average diameter analysis of the undyed area, an image analysis was performed using an image analysis software (product name: A-zoukun, available from Asahi Kasei Engineering Corporation) to determine a circle equivalent diameter, and a value of the circle equivalent diameter was determined as the average diameter.

The main conditions were as follows.

Analysis method: particle analyzing mode

Brightness of particles: dark

Analysis item: circle equivalent diameter

Binarization threshold: 100 or less (Component Analysis of Toner by Pyrolysis-Gas Chromatography-Mass Spectrometry)

The component analysis of the toner was performed by the following method, by means of the following device, under the following conditions.

(Treatment of Sample)

To a sample (about 1 mg), about 1 μL of a methylating agent (20% tetramethylammonium hydroxide (TMAH) methanol solution) was added dropwise. The resultant was provided for a measurement as a sample.

(Measurement)

Pyrolysis-gas chromatography-mass spectrometer (Py-GC/MS)

Analysis device: QP2010, available from Shimadzu Corporation

Heating furnace: Py2020D, available from Frontier Laboratories Ltd.

Heating temperature: 320° C.

Column: Ultra ALLOY-5L=30 m I.D.=0.25 mm

Film=0.25 μm

Column temperature: 50° C. (retained for 1 min), heating (10° C./min), 340° C. (retained for 7 min)

Split ratio: 1/100

Column flow rate: 1.0 mL/min

Ionization method: EI method (70 eV)

Measuring mode: scan mode

Data for searching: NIST 20 MASS SPECTRAL LIB.

(Component Analysis of Toner by NMR)

The component analysis of the toner was performed by the following method, by means of the following device, under the following conditions.

(Preparation of Sample)

(1) Sample for $^{1}$H-NMR

A sample (from about 40 mg through about 50 mg) was dissolved in about 0.7 mL (d=1.48) of $CDCl_3$ containing TMS. The resultant was provided for a measurement as a sample.

(2) Sample for $^{13}$C-NMR

A sample (from about 250 mg through about 260 mg) was dissolved in about 0.7 mL (d=1.48) of $CDCl_3$ containing TMS. The resultant was provided for a measurement as a sample.

(Analysis Device and Measuring Conditions)

ECX-500 NMR spectrometer available from JEOL Ltd.

(1) Measuring nuclear=$^{1}$H (500 MHz), measurement pulse file=single pulse, ex2 ($^{1}$H), 45° pulse Integration: 16 times, relaxation delay: 5 seconds, data point: 32 K, observation width=15 ppm (2) Measuring nuclear=$^{13}$C (125 MHz), measurement pulse file=single pulse dec. ex2($^{1}$H), 30° pulse Integration: 1,000 times (1,039 times only with RNC-501), relaxation delay: 2 seconds, data point: 32 K, Offset: 100 ppm, observation width=250 ppm (Analysis of Toluene-Insoluble Component and Chloroform-Soluble Component)

To 5 g of the toner, 100 g of toluene was added, and the resultant mixture was left to stand for 24 hours. Thereafter, the resultant was subjected to centrifuge by means of a centrifugal separator (HIMAC CP100NX, available from Hitachi, Ltd.) at a rotational speed of 3,000 rpm. After precipitation of the insoluble product, the insoluble product was separated by decantation. To 1 g of the insoluble product, 20 g of chloroform was added, and the resultant mixture was left to stand for 24 hours. Thereafter, centrifuge was performed in the same manner as described above, to thereby remove the insoluble product. The solution component was evaporated, dried, and solidified, and the obtained component was then subjected to a component analysis by GC-MS. Note that, the method of the component analysis was the same as the method described above.

Production Example 1

—Synthesis of Crystalline Resin A1—

A 5 L reaction vessel equipped with a stirring device, a temperature sensor, a cooling tube, and a nitrogen inlet device was charged with 300 parts of 1,12-dodecanedioic acid (polyvalent carboxylic acid), and 210 parts of 1,9-nonanediol (polyvalent alcohol). The inner temperature of the above reaction system was elevated to 190° C. over 1 hour with stirring. After confirming that the mixture was homogeneously stirred, $Ti(OBu)_4$ serving as a catalyst was added in an amount of 0.003% by mass relative to the amount of the polyvalent carboxylic acid. Thereafter, the internal temperature was elevated from 190° C. to 240° C. over 6 hours with removing water as generated. Moreover, a dehydration condensation reaction was allowed to continue for 6 hours at the temperature of 240° C. to perform polymerization, to thereby obtain Crystalline Resin A1.

Crystalline Resin A1 was found to have a melting point of 75° C. and a softening point of 92° C.

Production Example 2

—Synthesis of Crystalline Resin A2—

A 5 L reaction vessel equipped with a stirring device, a temperature sensor, a cooling tube, and a nitrogen inlet device was charged with 300 parts of 1,12-dodecanedioic acid (polyvalent carboxylic acid), and 220 parts of 1,9-nonanediol (polyvalent alcohol). The inner temperature of the above reaction system was elevated to 190° C. over 1 hour with stirring. After confirming that the mixture was homogeneously stirred, $Ti(OBu)_4$ serving as a catalyst was added in an amount of 0.003% by mass relative to the amount of the polyvalent carboxylic acid. Thereafter, the internal temperature was elevated from 190° C. to 240° C. over 6 hours with removing water as generated. Moreover, a dehydration condensation reaction was allowed to continue for 6 hours at the temperature of 240° C. to perform polymerization, to thereby obtain Crystalline Resin A2.

Crystalline Resin A2 was found to have a melting point of 75° C. and a softening point of 85° C.

Production Example 3

—Synthesis of Crystalline Resin A3—

A 5 L reaction vessel equipped with a stirring device, a temperature sensor, a cooling tube, and a nitrogen inlet device was charged with 300 parts of 1,12-dodecanedioic acid (polyvalent carboxylic acid), and 230 parts of 1,10-decanediol (polyvalent alcohol). The inner temperature of the above reaction system was elevated to 190° C. over 1 hour with stirring. After confirming that the mixture was homogeneously stirred, $Ti(OBu)_4$ serving as a catalyst was added in an amount of 0.003% by mass relative to the amount of the polyvalent carboxylic acid. Thereafter, the internal temperature was elevated from 190° C. to 240° C. over 6 hours with removing water as generated. Moreover, a dehydration condensation reaction was allowed to continue for 6 hours at the temperature of 240° C. to perform polymerization, to thereby obtain Crystalline Resin A3.

Crystalline Resin A3 was found to have a melting point of 65° C. and a softening point of 92° C.

Production Example 4

—Synthesis of Crystalline Resin A4—

A 5 L reaction vessel equipped with a stirring device, a temperature sensor, a cooling tube, and a nitrogen inlet device was charged with 300 parts of adipic acid (polyvalent carboxylic acid), and 250 parts of 1,6-hexanediol (polyvalent alcohol). The inner temperature of the above reaction system was elevated to 190° C. over 1 hour with stirring. After confirming that the mixture was homogeneously stirred, $Ti(OBu)_4$ serving as a catalyst was added in an amount of 0.003% by mass relative to the amount of the polyvalent carboxylic acid. Thereafter, the internal temperature was elevated from 190° C. to 240° C. over 6 hours with removing water as generated. Moreover, a dehydration condensation reaction was allowed to continue for 6 hours at the temperature of 240° C. to perform polymerization, to thereby obtain Crystalline Resin A4.

Crystalline Resin A4 was found to have a melting point of 105° C. and a softening point of 92° C.

Production Example 5

—Synthesis of Crystalline Resin A5—

A 5 L reaction vessel equipped with a stirring device, a temperature sensor, a cooling tube, and a nitrogen inlet device was charged with 300 parts of succinic acid (polyvalent carboxylic acid), and 230 parts of 1,4-butanediol (polyvalent alcohol). The inner temperature of the above reaction system was elevated to 190° C. over 1 hour with stirring. After confirming that the mixture was homogeneously stirred, $Ti(OBu)_4$ serving as a catalyst was added in an amount of 0.003% by mass relative to the amount of the polyvalent carboxylic acid. Thereafter, the internal temperature was elevated from 190° C. to 240° C. over 6 hours with removing water as generated. Moreover, a dehydration condensation reaction was allowed to continue for 6 hours at the temperature of 240° C. to perform polymerization, to thereby obtain Crystalline Resin A5.

Crystalline Resin A5 was found to have a melting point of 110° C. and a softening point of 92° C.

Production Example 6

—Synthesis of Crystalline Resin A6—

A 5 L reaction vessel equipped with a stirring device, a temperature sensor, a cooling tube, and a nitrogen inlet device was charged with 60 parts of fumaric acid (polyvalent carboxylic acid), 240 parts of adipic acid (polyvalent carboxylic acid), and 510 parts of 1,4-butanediol (polyvalent alcohol). The inner temperature of the above reaction system was elevated to 190° C. over 1 hour with stirring. After confirming that the mixture was homogeneously stirred, $Ti(OBu)_4$ serving as a catalyst was added in an amount of 0.003% by mass relative to the amount of the polyvalent carboxylic acid. Thereafter, the internal temperature was elevated from 190° C. to 240° C. over 6 hours with removing water as generated. Moreover, a dehydration condensation reaction was allowed to continue for 6 hours at the temperature of 240° C. to perform polymerization, to thereby obtain Crystalline Resin A6.

Crystalline Resin A6 was found to have a melting point of 115° C. and a softening point of 92° C.

Production Example 7

—Amorphous Resin B1—

A reaction tank equipped with a cooling tube, a stirring device, and a nitrogen inlet tube was charged with 215 part of propylene oxide (2 mol) adduct of bisphenol A, 132 parts of ethylene oxide (2 mol) adduct of bisphenol A, 126 parts of terephthalic acid, and 1.8 parts of tetrabutoxy titanate serving as a condensation catalyst. The resultant mixture was allowed to react for 6 hours at 230° C. under a flow of nitrogen gas with removing water as generated.

Subsequently, the resultant was allowed to react for 1 hour under a reduced pressure of from 5 mmHg through 20 mmHg, followed by cooling to 180° C. Thereafter, 10 parts of trimellitic anhydride was added to the resultant, and the mixture was then allowed to react under a reduced pressure of from 5 mmHg through 20 mmHg, until the weight average molecular weight of the reaction product reached 15,000, to thereby obtain Amorphous Resin B1 having a glass transition temperature of 61° C. and a softening point of 110° C.

Production Example 8

—Synthesis of Amorphous Resin B2—

A reaction tank equipped with a cooling tube, a stirring device, and a nitrogen inlet tube was charged with 220 part of propylene oxide (2 mol) adduct of bisphenol A, 135 parts of ethylene oxide (2 mol) adduct of bisphenol A, 126 parts of terephthalic acid, and 1.8 parts of tetrabutoxy titanate serving as a condensation catalyst. The resultant mixture was allowed to react for 6 hours at 230° C. under a flow of nitrogen gas with removing water as generated.

Subsequently, the resultant was allowed to react for 1 hour under a reduced pressure of from 5 mmHg through 20 mmHg, followed by cooling to 180° C. Thereafter, 10 parts of trimellitic anhydride was added to the resultant, and the mixture was then allowed to react under a reduced pressure of from 5 mmHg through 20 mmHg, until the weight average molecular weight of the reaction product reached 10,000, to thereby obtain Amorphous Resin B2 having a glass transition temperature of 55° C. and a softening point of 106° C.

Production Example 9

—Synthesis of Amorphous Resin B3—

A mixed solution containing 120 parts of acrylic acid, 2,150 parts of styrene, 540 parts of 2-ethylhexylacrylate, and 110 parts of dibutyl peroxide serving a radical polymerization initiator was added dropwise over 1 hour. Thereafter, the temperature of the resultant was maintained at 160° C. for 30 minutes, and was then elevated to 200° C., followed by allowing the mixture to react for 1 hour under a reduced pressure of 8 kPa. To the resultant, 4 parts of a radical polymerization inhibitor (4-t-butylcatechol) was added, and the resultant was heated to 210° C. over 2 hours. Thereafter, the resultant was allowed to react for 1 hour at 210° C., followed by reacting at 40 kPa until a softening point of the reaction product reached 112° C., to thereby obtain Amorphous Resin B3.

Amorphous Resin B3 was found to have a glass transition temperature of 62° C. and a softening point of 112° C.

Production Example 10

—Synthesis of Composite Resin C1—

A 10 L four-necked flask equipped with a thermometer, a stainless-steel stirring bar, a down-flow condenser, and a nitrogen inlet tube was charged with 2,480 parts of a bisphenol A-PO adduct, 690 parts of terephthalic acid, 25 parts of tin di(2-ethylhexanoate) serving as an esterification catalyst, and 1.6 parts of an esterification accelerator (gallic acid). The resultant mixture was heated to 235° C. over 2 hours in a nitrogen atmosphere using a mantle heater.

After confirming that the reaction rate reached 95% or greater at 235° C., the reaction mixture was cooled to 160° C. To the reaction mixture, a mixed solution containing 270 parts of acrylic acid, 4,800 parts of styrene, 1,200 parts of 2-ethylhexylacrylate, and 250 parts of dibutyl peroxide serving as a radical polymerization initiator was added dropwise over 1 hour. Thereafter, the temperature of the resultant mixture was maintained at 160° C. for 30 minutes, followed by heating up to 200° C. The mixture was then further allowed to react for 1 hour under a reduced pressure of 8 kPa, followed by cooling to 180° C.

Thereafter, 4 parts of a radical polymerization inhibitor (4-t-butylcatechol) and 240 parts of fumaric acid were added to the reaction mixture, and the resultant was heated to 210° C. over 2 hours. Thereafter, the resultant was allowed to react for 1 hour at 210° C., followed by reacting at 40 kPa until a softening point of the reaction product reached 112° C., to thereby obtain Composite Resin C1.

Note that, in the present specification, the reaction rate is a value determined by an amount of generated reaction water (mol)/a theoretical amount of generated water (mol)×100.

Composite Resin C1 was found to have a glass transition temperature of 59° C. and a softening point of 112° C.

The monomer composition, melting point, glass transition temperature, and softening point of each resin obtained above are presented in Tables 1-1 and 1-2.

TABLE 1-1

| Production Ex. | | Acid monomer | Alcohol monomer | Vinyl monomer | Melting point (° C.) |
|---|---|---|---|---|---|
| 1 | Crystalline Resin A1 | 1,12-dodecanedioic acid | 1,9-nonanediol | | 75 |
| 2 | Crystalline Resin A2 | 1,12-dodecanedioic acid | 1,9-nonanediol | | 75 |
| 3 | Crystalline Resin A3 | 1,12-dodecanedioic acid | 1,10-decanediol | | 65 |
| 4 | Crystalline Resin A4 | adipic acid | 1,6-hexanediol | | 105 |
| 5 | Crystalline Resin A5 | succinic acid | 1,4-butanediol | | 110 |
| 6 | Crystalline Resin A6 | fumaric acid<br>adipic acid | 1,4-butanediol | | 115 |

TABLE 1-1-continued

| Production Ex. | | Acid monomer | Alcohol monomer | Vinyl monomer | Melting point (° C.) |
|---|---|---|---|---|---|
| 7 | Amorphous Resin B1 | terephthalic acid trimellitic anhydride | bisphenolA-PO adduct bisphenolA-EO adduct | | |
| 8 | Amorphous Resin B2 | terephthalic acid trimellitic anhydride | bisphenolA-PO adduct bisphenolA-EO adduct | | |
| 9 | Amorphous Resin B3 | | | acrylic acid styrene 2-ethylhexylacrylate | |
| 10 | Composite Resin C1 | terephthalic acid fumaric acid | bisphenolA-PO adduct | acrylic acid styrene 2-ethylhexylacrylate | |

TABLE 1-2

| Production Ex. | | Melting point (° C.) | Tg (° C.) | Softening point (° C.) |
|---|---|---|---|---|
| 1 | Crystalline Resin A1 | 75 | | 92 |
| 2 | Crystalline Resin A2 | 75 | | 85 |
| 3 | Crystalline Resin A3 | 65 | | 92 |
| 4 | Crystalline Resin A4 | 105 | | 92 |
| 5 | Crystalline Resin A5 | 110 | | 92 |
| 6 | Crystalline Resin A6 | 115 | | 92 |
| 7 | Amorphous Resin B1 | | 61 | 110 |
| 8 | Amorphous Resin B2 | | 55 | 106 |
| 9 | Amorphous Resin B3 | | 62 | 112 |
| 10 | Composite Resin C1 | | 59 | 112 |

Example 1

—Production of Toner 1—

Crystalline Resin A1: 10 parts

Amorphous Resin B1: 58 parts

Composite Resin C1: 30 parts

Carnauba Wax (WA-05, available from CERARICA NODA Co., Ltd.): 2 parts

Colorant (C-44, available from Mitsubishi Chemical Corporation): 8 parts

The above-listed toner raw materials were mixed in advance by means of HENSCHEL MIXER (FM20B, available from NIPPON COKE & ENGINEERING CO., LTD.), followed by kneading by a continuous twin-open-roll kneader KNEADEX (available from NIPPON COKE & ENGINEERING CO., LTD.) to thereby obtain a kneaded product.

Note that, the continuous twin-open-roll kneader for use had a roll outer diameter of 0.14 m, and an effective roll length of 0.8 m. As for the operation conditions thereof, the rotational speed of the heating roll was 34 r/min (circumferential velocity: 4.8 m/min), the rotational speed of the cooling roll was 29 r/min (circumferential velocity: 4.1 m/min), and the roll gap was 0.2 mm.

As for the temperatures of the heating and cooling media in the rolls, the temperatures were set as follows. The temperature of the heating roll at the side where the raw materials were introduced was 125° C., and the temperature thereof at the side where the kneaded product was discharged was 75° C. The temperature of the cooling roll at the side where the raw materials were introduced was 35° C., and the temperature thereof at the side where the kneaded product was discharged was 30° C. Moreover, the supply speed of the raw material mixture was set to 5 kg/h.

After cooling the obtained kneaded product in the air, the kneaded product was coarsely ground by an atomizer, to thereby obtain a coarsely ground product having the maximum diameter of 2 mm or smaller.

The obtained coarsely ground product was finely ground by an impact jet mill, IDS5 (available from Nippon Pneumatic Mfg., Co., Ltd.), the wind pressure of which at the time of grinding was adjusted to 0.5 MPa. The finely ground product was then classified by an air classifier, DS5 (available from Nippon Pneumatic Mfg., Co., Ltd.) with the volume median diameter (D50) of 6.5 μm±0.3 μm as a target, to thereby obtain toner base particles. Subsequently, 1.0 part of an additive, HDK-2000 (available from Clariant K.K.), and 1.0 part of an additive, H05TD (available from Clariant K.K.) were mixed with 100 parts by mass of the toner base particles, and the mixture was stirred by HENSCHEL MIXER, to thereby produce Toner 1.

Example 2

—Production of Toner 2—

Crystalline Resin A2: 10 parts

Amorphous Resin B1: 58 parts

Composite Resin C1: 30 parts

Carnauba Wax (WA-05, available from CERARICA NODA Co., Ltd.): 2 parts

Colorant (C-44, available from Mitsubishi Chemical Corporation): 8 parts

Toner 2 was produced in the same manner as in the production of Toner 1, except that the above-listed materials were used.

Example 3

—Production of Toner 3—

Crystalline Resin A1: 10 parts

Amorphous Resin B1: 52 parts

Composite Resin C1: 36 parts

Carnauba Wax (WA-05, available from CERARICA NODA Co., Ltd.): 2 parts

Colorant (C-44, available from Mitsubishi Chemical Corporation): 8 parts

Toner 3 was produced in the same manner as in the production of Toner 1, except that the above-listed materials were used.

Example 4

—Production of Toner 4—

Crystalline Resin A3: 10 parts

Amorphous Resin B1: 58 parts

Composite Resin C1: 30 parts

Carnauba Wax (WA-05, available from CERARICA NODA Co., Ltd.): 2 parts

Colorant (C-44, available from Mitsubishi Chemical Corporation): 8 parts

Toner 4 was produced in the same manner as in the production of Toner 1, except that the above-listed materials were used.

Example 5

—Production of Toner 5

Crystalline Resin A4: 10 parts

Amorphous Resin B1: 58 parts

Composite Resin C1: 30 parts

Carnauba Wax (WA-05, available from CERARICA NODA Co., Ltd.): 2 parts

Colorant (C-44, available from Mitsubishi Chemical Corporation): 8 parts

Toner 5 was produced in the same manner as in the production of Toner 1, except that the above-listed materials were used.

Example 6

—Production of Toner 6—

Crystalline Resin A1: 10 parts

Amorphous Resin B2: 58 parts

Composite Resin C1: 30 parts

Carnauba Wax (WA-05, available from CERARICA NODA Co., Ltd.): 2 parts

Colorant (C-44, available from Mitsubishi Chemical Corporation): 8 parts

Toner 6 was produced in the same manner as in the production of Toner 1, except that the above-listed materials were used.

Example 7

—Production of Toner 7—

Crystalline Resin A5: 10 parts

Amorphous Resin B1: 58 parts

Composite Resin C1: 30 parts

Carnauba Wax (WA-05, available from CERARICA NODA Co., Ltd.): 2 parts

Colorant (C-44, available from Mitsubishi Chemical Corporation): 8 parts

Toner 7 was produced in the same manner as in the production of Toner 1, except that the above-listed materials were used.

Example 8

—Production of Toner 8—

Crystalline Resin A1: 10 parts

Amorphous Resin B1: 88 parts

Carnauba Wax (WA-05, available from CERARICA NODA Co., Ltd.): 2 parts

Colorant (C-44, available from Mitsubishi Chemical Corporation): 8 parts

Toner 8 was produced in the same manner as in the production of Toner 1, except that the above-listed materials were used.

Example 9

—Production of Toner 9—

Crystalline Resin A1: 10 parts

Amorphous Resin B1: 58 parts

Composite Resin C1: 30 parts

Carnauba Wax (WA-05, available from CERARICA NODA Co., Ltd.): 2 parts

Colorant (C-44, available from Mitsubishi Chemical Corporation): 8 parts

In the same manner as in Example 1, the above-listed toner raw materials were mixed in advance by means of HENSCHEL MIXER (FM20B, available from NIPPON COKE & ENGINEERING CO., LTD.), followed by kneading by a continuous twin-open-roll kneader KNEADEX (available from NIPPON COKE & ENGINEERING CO., LTD.) to thereby obtain a kneaded product. After cooling the obtained kneaded product in the air, the kneaded product was coarsely ground by an atomizer, to thereby obtain a coarsely ground product having the maximum diameter of 2 mm or smaller.

Note that, the same continuous twin-open-roll kneader as the one used in Example 1 was used, but the kneading conditions were changed as follows.

Specifically, the temperature of the heating roll at the side where the raw materials were introduced was set to 135° C., the temperature thereof at the side where the kneaded product was discharged was set to 85° C., the temperature of the cooling roll at the side where the raw materials were introduced was set to 35° C., and the temperature thereof at the side where the kneaded product was discharged was set to 40° C. Moreover, the supply speed of the raw material mixture was set to 8 kg/h.

The obtained coarsely ground product was finely ground by an impact jet mill, IDS5 (available from Nippon Pneumatic Mfg., Co., Ltd.), the wind pressure of which at the time of grinding was adjusted to 0.5 MPa. The finely ground product was then classified by an air classifier, DS5 (available from Nippon Pneumatic Mfg., Co., Ltd.) with the volume median diameter (D50) of 6.5 μm±0.3 μm as a target, to thereby obtain toner base particles. Subsequently, 1.0 part of an additive, HDK-2000 (available from Clamant K.K.), and 1.0 part of an additive, H05TD (available from Clamant K.K.) were mixed with 100 parts by mass of the toner base particles, and the mixture was stirred by HENSCHEL MIXER, to thereby produce Toner 9.

Example 10

—Production of Toner 10—

Crystalline Resin A1: 10 parts

Amorphous Resin B1: 58 parts

Composite Resin C1: 30 parts

Carnauba Wax (WA-05, available from CERARICA NODA Co., Ltd.): 2 parts

Colorant (C-44, available from Mitsubishi Chemical Corporation): 8 parts

The above-listed toner raw materials were mixed in advance by means of HENSCHEL MIXER (FM20B, available from NIPPON COKE & ENGINEERING CO., LTD.), followed by melted and kneaded at the temperature of from 100° C. through 130° C. by means of a monoaxial kneader (Cokneader, available from Buss Compounding Systems AG), to thereby obtain a kneaded product.

After cooling the obtained kneaded product to room temperature, the kneaded product was coarsely ground down to the range of from 200 μm through 300 μm by Rotoplex. Subsequently, the coarsely ground product was finely ground by a counter jet mill (100AFG, available from HOSOKAWA MICRON CORPORATION) with appropriately adjusting the grinding air pressure to give the weight average particle diameter of 6.2 μm±0.3 μm. The resultant ground product was classified by an air classifier (EJ-LABO, available from MATSUBO Corporation) with appropriately adjusting an opening degree of a louver to give a weight average particle diameter of 7.0 μm±0.2 μm, and a ratio (weight average particle diameter/number average particle diameter) of 1.20 or less, to thereby obtain toner base particles. Subsequently, 1.0 part of an additive, HDK-2000 (available from Clamant K.K.), and 1.0 part of an additive, H05TD (available from Clamant K.K.) were mixed with 100 parts by mass of the toner base particles, and the mixture was stirred by HENSCHEL MIXER, to thereby produce Toner 10.

Example 11

—Production of Toner 11—
Crystalline Resin A1: 10 parts
Amorphous Resin B3: 58 parts
Composite Resin C1: 30 parts
Carnauba Wax (WA-05, available from CERARICA NODA Co., Ltd.): 2 parts
Colorant (C-44, available from Mitsubishi Chemical Corporation): 8 parts
Toner 11 was produced in the same manner as in the production of Toner 1, except that the above-listed materials were used.

Example 12

—Production of Toner 12—
Crystalline Resin A1: 7 parts
Amorphous Resin B1: 58 parts
Composite Resin C1: 30 parts
Carnauba Wax (WA-05, available from CERARICA NODA Co., Ltd.): 5 parts
Colorant (C-44, available from Mitsubishi Chemical Corporation): 8 parts
Toner 12 was produced in the same manner as in the production of Toner 10, except that the above-listed materials were used.

Example 13

—Production of Toner 13—
Crystalline Resin A1: 7 parts
Amorphous Resin B1: 57 parts
Composite Resin C1: 30 parts
Carnauba Wax (WA-05, available from CERARICA NODA Co., Ltd.): 6 parts
Colorant (C-44, available from Mitsubishi Chemical Corporation): 8 parts
Toner 13 was produced in the same manner as in the production of Toner 10, except that the above-listed materials were used.

Example 14

—Production of Toner 14—
Crystalline Resin A1: 4 parts
Amorphous Resin B1: 64 parts
Composite Resin C1: 30 parts
Carnauba Wax (WA-05, available from CERARICA NODA Co., Ltd.): 2 parts
Colorant (C-44, available from Mitsubishi Chemical Corporation): 8 parts
Toner 14 was produced in the same manner as in the production of Toner 10, except that the above-listed materials were used.

Example 15

—Production of Toner 15—
Crystalline Resin A1: 3 parts
Amorphous Resin B1: 65 parts
Composite Resin C1: 30 parts
Carnauba Wax (WA-05, available from CERARICA NODA Co., Ltd.): 2 parts
Colorant (C-44, available from Mitsubishi Chemical Corporation): 8 parts
Toner 15 was produced in the same manner as in the production of Toner 10, except that the above-listed materials were used.

Comparative Example 1

—Production of Toner 16—
Amorphous Resin B1: 68 parts
Composite Resin C1: 30 parts
Carnauba Wax (WA-05, available from CERARICA NODA Co., Ltd.): 2 parts
Colorant (C-44, available from Mitsubishi Chemical Corporation): 8 parts
Toner 16 was produced in the same manner as in the production of Toner 1, except that the above-listed materials were used.

Comparative Example 2

—Production of Toner 17—
Crystalline Resin A6: 10 parts
Amorphous Resin B1: 58 parts
Composite Resin C1: 30 parts
Carnauba Wax (WA-05, available from CERARICA NODA Co., Ltd.): 2 parts
Colorant (C-44, available from Mitsubishi Chemical Corporation): 8 parts
Toner 17 was produced in the same manner as in the production of Toner 1, except that the above-listed materials were used.

Each of the obtained toners was subjected to the following measurements. The measurements included a difference (Tg variation width) between the glass transition temperature observed in the last heating step in the heating and cooling conditions 1, and the glass transition temperature observed in the last heating step in the heating and cooling conditions 2, a diffraction peak of the toner as measured by X-ray diffraction analysis, the average diameter of the undyed areas after dying a cross-section of the toner with ruthenium, a melting point, and a glass transition temperature.

Moreover, pyrolysis-gas chromatography-mass spectrometry was performed on the toner to detect monomers. An amount of the vinyl monomer detected was determined by means of a nuclear magnetic resonance spectrometer (NMR).

Moreover, M2/(M1+M2), and softening points of a toluene-insoluble component, and a chloroform-soluble component were measured. Here, M1 is a mass of a toluene-soluble component, and M2 is a mass of the chloroform-soluble component, when the toner was added to toluene to separate the toluene-soluble component from the toluene-insoluble component, and the chloroform-soluble component is separated from the separated toluene-soluble component.

Subsequently, the obtained toner was evaluated as follows.

(Minimum Fixing Temperature)

A solid image in the size of 3 cm×8 cm was formed on a photocopy printing sheet <70> (available from RICOH JAPAN Corp.) with a toner deposition amount of 0.85 $mg/cm^2 \pm 0.1$ $mg/cm^2$ by means of a modified device of an electrophotographic photocopier (MF-200, available from Ricoh Company Limited), a fixing unit of which had been modified with a Teflon (registered trade mark) roller serving as a fixing roller. Thereafter, the solid image was fixed with varying a temperature of the fixing belt of the device. Subsequently, a surface of the fixed image was scratched with a ruby needle (radius of a tip: from 260 mm through 320 mm, point angle: 60°) at a load of 50 g by means of a scratch drawing testing device AD-401 (available from Ueshima Seisakusho Co., Ltd.). The drawn surface was then strongly rubbed 5 times with fibers (HANICOT #440, available from Haniron K.K.). The temperature of the fixing belt at which scraping of the image was almost nonexistent was regarded as the minimum fixing temperature. The solid image was formed at the position that was 3.0 cm apart from the edge of the sheet along the feeding direction, and the speed for passing the sheet through the nip of the fixing device was 280 mm/s. The lower the minimum fixing temperature is, the more preferable low-temperature fixing ability of the toner is. The minimum fixing temperature was evaluated based on the following criteria. The result of D was regarded as unacceptable.

(Evaluation Criteria)

A: Lower than 140° C.

B: 140° C. or higher but lower than 145° C.

C: 145° C. or higher but lower than 150° C.

D: 150° C. or higher (Heat-Resistant Storage Stability-Penetration Degree)

A 10 mL glass container was charged with each toner, and was then left to stand in a thermostat of 50° C. for 24 hours.

The toner was then cooled to 25° C., and was subjected to a measurement of a penetration degree (mm) by a penetration test (JIS K2235-1991). The results were evaluated based on the following criteria. The larger the value of the penetration degree is, the more preferable heat-resistant storage stability of the toner is.

The heat-resistant storage stability was evaluated based on the value of the penetration degree (mm) according to the following criteria. The result of D was regarded as unacceptable.

A: 15 mm or greater

B: 10 mm or greater but less than 15 mm

C: 5 mm or greater but less than 10 mm

D: Less than 5 mm (Stress Resistance: Amount of Loose Aggregates as Pressed at Normal Temperature)

A toner was weighed in an amount of 0.5 g in a tube for centrifuge, followed by rotating by means of a centrifugal separator CP100MX (available from Hitachi Koki Co., Ltd.) for 5 minutes at 25° C., and the rotational speed of 8,500 rpm (applied pressure: 0.25 MPa). Thereafter, the resultant was sieved through a mesh having an opening size of 106 μm. The amount of the loose aggregates remaining on the mesh was measured.

The stress resistance was evaluated based on the value of the amount of the loose aggregates according to the following criteria. The result of D was regarded as unacceptable.

(Evaluation Criteria)

A: 150 mg/g or less

B: Greater than 150 mg/g but 200 mg/g or less

C: Greater than 200 mg/g but 250 mg/g or less

D: Greater than 250 mg/g (Stress Resistance: Number of White Missing Spots)

A chart having an imaging area of 0.5% was output on 50,000 sheets by means of an image forming apparatus, IMAGIO MP C5002 (available from Ricoh Company Limited). Thereafter, the presence of areas where the toner was missing in the image area was observed, when a solid image formed on the entire sheet was output. Then, stress resistance was evaluated.

Note that, the number of the areas where the toner was missing in the image area in the form of white spots was counted, and was determined as the number of white missing spots.

A level with which there was no problem on practical use was 2 or less white missing spots in the image of A4. No white missing spot in the image of A4 was judged as A, the image having one white missing spot was judged as B, the image having two white missing spots was judged as C, and the image having three or more white missing spots was judged as D.

The evaluation results of the toner are presented in Tables 2-1, 2-2, 2-3, 2-4, and 3.

TABLE 2-1

| | | Monomer composition of resins | | | | |
|---|---|---|---|---|---|---|
| | Resin | Acid monomer | Alcohol monomer | Vinyl monomer | Amount of vinyl monomer (%) | Toluene-insoluble component/ chloroform-soluble component |
| Ex. 1 | A1<br>B1<br>C1 | terephthalic acid<br>fumaric acid<br>trimellitic anhydride<br>1,12-dodecanedioic acid | bisphenol A(PO adduct)<br>bisphenol A(EO adduct)<br>1,9-nonanediol | acrylic acid<br>styrene<br>2-ethylhexylacrylate | 18 | 1,12-dodecanedioic acid<br>1,9-nonanediol |
| Ex. 2 | A2<br>B1<br>C1 | terephthalic acid<br>fumaric acid<br>trimellitic anhydride<br>1,12-dodecanedioic acid | bisphenol A(PO adduct)<br>bisphenol A(EO adduct)<br>1,9-nonanediol | acrylic acid<br>styrene<br>2-ethylhexylacrylate | 18 | 1,12-dodecanedioic acid<br>1,9-nonanediol |

TABLE 2-1-continued

| | Monomer composition of resins | | | | | |
|---|---|---|---|---|---|---|
| | Resin | Acid monomer | Alcohol monomer | Vinyl monomer | Amount of vinyl monomer (%) | Toluene-insoluble component/ chloroform-soluble component |
| Ex. 3 | A1<br>B1<br>C1 | terephthalic acid<br>fumaric acid<br>trimellitic anhydride<br>1,12-dodecanedioic acid | bisphenol A(PO adduct)<br>bisphenol A(EO adduct)<br>1,9-nonanediol | acrylic acid<br>styrene<br>2-ethylhexylacrylate | 22 | 1,12-dodecanedioic acid<br>1,9-nonanediol |
| Ex. 4 | A3<br>B1<br>C1 | terephthalic acid<br>fumaric acid<br>trimellitic anhydride<br>1,12-dodecanedioic acid | bisphenol A(PO adduct)<br>bisphenol A (EO adduct)<br>1,10-decanediol | acrylic acid<br>styrene<br>2-ethylhexylacrylate | 18 | 1,12-dodecanedioic acid<br>1,10-nonanediol |
| Ex. 5 | A4<br>B1<br>C1 | terephthalic acid<br>fumaric acid<br>trimellitic anhydride<br>adipic acid | bisphenol A(PO adduct)<br>bisphenol A(EO adduct)<br>1,8-hexanediol | acrylic acid<br>styrene<br>2-ethylhexylacrylate | 18 | adipic acid<br>1,6-hexanediol |
| Ex. 6 | A1<br>B2<br>C1 | terephthalic acid<br>fumaric acid<br>trimellitic anhydride<br>1,12-dodecanedioic acid | bisphenol A(PO adduct)<br>bisphenol A(EO adduct)<br>1,9-nonanediol | acrylic acid<br>styrene<br>2-ethylhexylacrylate | 18 | 1,12-dodecanedioic acid<br>1,9-nonanediol |
| Ex. 7 | A5<br>B1<br>C1 | terephthalic acid<br>fumaric acid<br>trimellitic anhydride<br>succinic acid | bisphenol A(PO adduct)<br>bisphenol A (EO adduct)<br>1,4-butanediol | acrylic acid<br>styrene<br>2-ethylhexylacrylate | 18 | succinic acid<br>1,4-butanediol |
| Ex. 8 | A1<br>B1 | terephthalic acid<br>trimellitic anhydride<br>1,12-dodecanedioic acid | bisphenol A(PO adduct)<br>bisphenol A(EO adduct)<br>1,9-nonanediol | NA | NA | 1,12-dodecanedioic acid<br>1,9-nonanediol |
| Ex. 9 | A1<br>B1<br>C1 | terephthalic acid<br>fumaric acid<br>trimellitic anhydride<br>1,12-dodecanedioic acid | bisphenol A(PO adduct)<br>bisphenol A(EO adduct)<br>1,9-nonanediol | acrylic acid<br>styrene<br>2-ethylhexylacrylate | 18 | 1,12-dodecanedioic acid<br>1,9-nonanediol |

TABLE 2-2

| | | Physical properties of toner | | | | | |
|---|---|---|---|---|---|---|---|
| | Toner formulation M2/(M1 + M2) | Tg variation width (° C.) | Diffraction peak (2θ) | Average diameter of undyed areas (nm) | Melting point (° C.) | Tg (° C.) | Softening point (° C.) |
| Ex. 1 | 0.12 | 5 | 22 | 90 | 75 | 56 | 92 |
| Ex. 2 | 0.12 | 5 | 23 | 110 | 75 | 57 | 88 |
| Ex. 3 | 0.12 | 7 | 22 | 80 | 75 | 53 | 92 |
| Ex. 4 | 0.12 | 5 | 23 | 90 | 65 | 56 | 92 |
| Ex. 5 | 0.12 | 5 | 24 | 70 | 105 | 56 | 92 |
| Ex. 6 | 0.12 | 5 | 22 | 90 | 75 | 53 | 92 |
| Ex. 7 | 0.12 | 9 | 21 | 50 | 110 | 58 | 92 |
| Ex. 8 | 0.12 | 5 | 22 | 160 | 75 | 56 | 92 |
| Ex. 9 | 0.12 | 5 | 22 | 180 | 75 | 56 | 92 |

TABLE 2-3

| | Monomer composition of resins | | | | | |
|---|---|---|---|---|---|---|
| | Resin | Acid monomer | Alcohol monomer | Vinyl monomer | Amount of vinyl monomer (%) | Toluene-insoluble component/ chloroform-soluble component |
| Ex. 10 | A1<br>B1<br>C1 | terephthalic acid<br>fumaric acid<br>trimellitic anhydride<br>1,12-dodecanedioic acid | bisphenol A(PO adduct)<br>bisphenol A (EO adduct)<br>1,9-nonanediol | acrylic acid<br>styrene<br>2-ethylhexylacrylate | 18 | 1,12-dodecanedioic acid<br>1,9-nonanediol |
| Ex. 11 | A1<br>B3<br>C1 | terephthalic acid<br>fumaric acid<br>1,12-dodecanedioic acid | bisphenol A(PO adduct)<br>1,9-nonanediol | acrylic acid<br>styrene<br>2-ethylhexylacrylate | 78 | 1,12-dodecanedioic acid<br>1,9-nonanediol |
| Ex. 12 | A1<br>B1<br>C1 | terephthalic acid<br>fumaric acid<br>trimellitic anhydride<br>1,12-dodecanedioic acid | bisphenol A(PO adduct)<br>bisphenol A (EO adduct)<br>1,9-nonanediol | acrylic acid<br>styrene<br>2-ethylhexylacrylate | 18 | 1,12-dodecanedioic acid<br>1,9-nonanediol |
| Ex. 13 | A1<br>B1<br>C1 | terephthalic acid<br>fumaric acid<br>trimellitic anhydride<br>1,12-dodecanedioic acid | bisphenol A(PO adduct)<br>bisphenol A (EO adduct)<br>1,9-nonanediol | acrylic acid<br>styrene<br>2-ethylhexylacrylate | 18 | 1,12-dodecanedioic acid<br>1,9-nonanediol |
| Ex. 14 | A1<br>B1<br>C1 | terephthalic acid<br>fumaric acid<br>trimellitic anhydride<br>1,12-dodecanedioic acid | bisphenol A(PO adduct)<br>bisphenol A (EO adduct)<br>1,9-nonanediol | acrylic acid<br>styrene<br>2-ethylhexylacrylate | 18 | 1,12-dodecanedioic acid<br>1,9-nonanediol |
| Ex. 15 | A1<br>B1<br>C1 | terephthalic acid<br>fumaric acid<br>trimellitic anhydride<br>1,12-dodecanedioic acid | bisphenol A(PO adduct)<br>bisphenol A (EO adduct)<br>1,9-nonanediol | acrylic acid<br>styrene<br>2-ethylhexylacrylate | 18 | 1,12-dodecanedioic acid<br>1,9-nonanediol |
| Comp. Ex. 1 | B1<br>C1 | terephthalic acid<br>fumaric acid<br>trimellitic anhydride | bisphenol A(PO adduct)<br>bisphenol A (EO adduct) | acrylic acid<br>styrene<br>2-ethylhexylacrylate | 18 | NA |
| Comp. Ex. 2 | A6<br>B1<br>C1 | terephthalic acid<br>fumaric acid<br>trimellitic anhydride<br>adipic acid | bisphenol A(PO adduct)<br>bisphenol A (EO adduct)<br>1,4-butanediol | acrylic acid<br>styrene<br>2-ethylhexylacrylate | 18 | fumaric acid<br>adipic acid<br>1,4-butanediol |

TABLE 2-4

| | Physical properties of toner | | | | | | |
|---|---|---|---|---|---|---|---|
| | Toner formulation M2/(M1 + M2) | Tg variation width (° C.) | Diffraction peak (2θ) | Average diameter of undyed areas (nm) | Melting point (° C.) | Tg (° C.) | Softening point (° C.) |
| Ex. 10 | 0.12 | 5 | 22 | 220 | 75 | 56 | 92 |
| Ex. 11 | 0.12 | 10 | 22 | 50 | 75 | 51 | 92 |
| Ex. 12 | 0.12 | 6 | 22 | 150 | 75 | 56 | 92 |
| Ex. 13 | 0.13 | 6 | 22 | 300 | 75 | 56 | 92 |
| Ex. 14 | 0.06 | 5 | 22 | 50 | 75 | 58 | 92 |
| Ex. 15 | 0.05 | 5 | 22 | 50 | 75 | 58 | 92 |
| Comp. Ex. 1 | 0.02 | 4 | NA | NA | NA | 60 | NA |
| Comp. Ex. 2 | 0.12 | 12 | 24 | 40 | 115 | 48 | 92 |

TABLE 3

| | Minimum fixing temperature | Penetration degree | Stress resistance (loose aggregate amount as pressed) | Stress resistance (white missing spots) |
|---|---|---|---|---|
| Ex. 1 | A | A | A | A |
| Ex. 2 | A | A | B | B |
| Ex. 3 | A | B | B | B |
| Ex. 4 | A | B | B | B |
| Ex. 5 | B | A | A | A |
| Ex. 6 | A | C | B | B |
| Ex. 7 | A | C | B | B |
| Ex. 8 | B | A | B | B |
| Ex. 9 | B | A | B | B |
| Ex. 10 | B | C | C | C |
| Ex. 11 | A | C | C | C |
| Ex. 12 | A | A | A | A |
| Ex. 13 | C | A | C | C |
| Ex. 14 | B | A | A | A |
| Ex. 15 | C | A | A | A |
| Comp. Ex. 1 | D | A | A | A |
| Comp. Ex. 2 | A | D | D | D |

REFERENCE SIGNS LIST

1 image forming apparatus
10 photoconductor drum
40 developing device
58 corona charger
80 transfer roller
90 cleaning device
110 process cartridge
210 paper feeding unit
211 paper feeding cassette
212 paper feeding roller
220 conveying unit
221 roller
222 timing roller
223 paper ejecting roller
224 paper ejecting tray
230 image forming unit
231 photoconductor drum
232 charger
233 exposing device
240 transfer unit
241 driving roller
242 driven roller
243 intermediate transfer belt
244Y, 244C, 244M, 244K primary transfer roller
245 secondary counter roller
246 secondary transfer roller
250 fixing device
251 fixing belt
252 press roller
P paper

The invention claimed is:

1. A toner, comprising:

a toluene-soluble component comprising an amorphous resin;

a chloroform-soluble component that is phase separated from the toluene-soluble component and comprises a crystalline polyester resin; and a composite resin comprising a polyester segment and a vinyl resin segment, wherein:

the crystalline polyester resin is formed by polycondensing a polyol and a polycarboxylic acid comprising an alkane dicarboxylic acid;

the toner satisfies the following relationship:

$$0.06 \leq M2/(M1+M2) \leq 0.12$$

where:

M1 is a mass of a toluene-soluble component of the toner, the toluene-soluble component being prepared by adding the toner in toluene and separating the toluene-soluble component from a toluene-insoluble component of the toner; and M2 is a mass of a chloroform-soluble component of the toner, the chloroform-soluble component being separated from the toluene-insoluble component;

a diffraction peak of the toner as measured by X-ray diffraction spectroscopy is present at least in a region where 2θ is from 20° through 25°;

an average diameter of undyed portions is 50 nm or greater but 200 nm or smaller, when a cross-section of the toner is dyed with ruthenium, followed by observing the cross-section of the toner through a scanning electron microscope (SEM) under reflected electron conditions; and a difference between Tg1 and Tg2 is 10° C. or less, wherein Tg1 is a glass transition temperature of the toner, as observed in a last heating step, when heating and cooling are performed on the toner by a differential scanning calorimeter (DSC) under heating and cooling conditions 1, and Tg2 is a glass transition temperature of the toner, as observed in a last heating step, when heating and cooling are performed on the toner by the differential scanning calorimeter (DSC) under heating and cooling conditions 2, the heating and cooling conditions 1 being as follows:

a starting temperature is 20° C., and the toner is heated from the starting temperature to 120° C. at 10° C./min, a temperature of the toner is retained at 120° C. for 10 minutes, the toner is cooled to 0° C. at 10° C./min, and a retention time at 0° C. is none, and the toner is heated to 150° C. at 10° C./min, the heating and cooling conditions 2 being as follows:

a starting temperature is 20° C., and the toner is heated from the starting temperature to 120° C. at 10° C./min, a temperature of the toner is retained at 120° C. for 10 minutes, the toner is cooled to 0° C. at 10° C./min, a retention time at 0° C. is none, and the toner is heated to 45° C. at 10° C./min, and a temperature of the toner is retained at 45° C. for 24 hours, the toner is cooled again to 0° C. at 10° C./min, and a retention time at 0° C. is none, and the toner is heated to 150° C. at 10° C./min.

2. The toner according to claim 1, wherein an average diameter of undyed portions is 50 nm or greater but 100 nm or smaller, when a cross-section of the toner is dyed with ruthenium, followed by observing the cross-section of the toner through a scanning electron microscope (SEM) under reflected electron conditions.

3. The toner according to claim 2, wherein the average diameter of the undyed portions is 100 nm or smaller.

4. The toner according to claim 1, wherein at least one acid monomer, at least one alcohol monomer, and at least one vinyl monomer are detected, when a component analysis is performed on the toner by a pyrolysis-gas chromatography-mass spectrometer (Py-GC/MS).

5. The toner according to claim 1, wherein:

an acid monomer and an alcohol monomer are detected, when a component analysis is performed on a chloroform-soluble component by a pyrolysis-gas chromatography-mass spectrometer (Py-GC/MS), the chloroform-soluble component being prepared by separating a toluene-insoluble component in the toner and separating the chloroform-soluble component from the toluene-insoluble component; and the acid monomer is fatty acid having 6 or more carbon atoms and the alcohol monomer is aliphatic alcohol comprising 6 or more carbon atoms.

6. The toner according to claim 1, wherein the toner has a melting point ranging from 70° C. through 100° C.

7. The toner according to claim 1, wherein the toner has a glass transition temperature of 55° C. or higher.

8. The toner according to claim 1, wherein a softening point measured on a chloroform-soluble component of the toner is 90° C. or higher, the chloroform-soluble component being prepared by separating a toluene-insoluble component in the toner and separating the chloroform-soluble component from the toluene-insoluble component.

9. The toner according to claim 1, wherein an amount of a vinyl monomer in the toner is 20% by mass or less, when a quantitative analysis is performed on the toner by a pyrolysis-gas chromatography-mass spectrometer (Py-GC/MS) and a nuclear magnetic resonance (NMR) spectrometer.

10. The toner according to claim 1, wherein an amount of the composite resin is from 27.2% by mass through 32.6% by mass.

11. An image forming apparatus, comprising:

a photoconductor;

a charging unit configured to charge the photoconductor;

an exposing unit configured to expose the photoconductor charged to light to form an electrostatic latent image;

a toner stored unit containing the toner of claim 1;

a developing unit configured to develop the electrostatic latent image formed on the photoconductor with the toner according to claim 1, to form a toner image;

a transfer unit configured to transfer the toner image onto a recording medium; and a fixing unit configured to fix the toner image transferred on the recording medium.

12. A toner stored unit comprising:

the toner according to claim 1.

* * * * *